US011512524B1

(12) United States Patent
Eison et al.

(10) Patent No.: US 11,512,524 B1
(45) Date of Patent: Nov. 29, 2022

(54) FIRE-RATED ELEVATOR DOOR FRAME AND TRANSOM FLUSH WITH DOOR

(71) Applicant: EP Acquisition, Inc., Minneapolis, MN (US)

(72) Inventors: Jashan Deshan Eison, Brooklyn Park, MN (US); Mark Gabriel Hamilton, Roseville, MN (US); William Theodore Sillman, Saint Paul, MN (US); Leo Joseph Tomperi, Brooklyn Park, MN (US)

( * ) Notice: Subject to any disclaimer, the term of this patent is extended or adjusted under 35 U.S.C. 154(b) by 0 days.

(21) Appl. No.: 16/934,973

(22) Filed: Jul. 21, 2020

Related U.S. Application Data

(60) Provisional application No. 62/877,130, filed on Jul. 22, 2019.

(51) Int. Cl.
*E06B 5/16* (2006.01)
*B66B 13/30* (2006.01)
*E06B 3/82* (2006.01)

(52) U.S. Cl.
CPC ..... *E06B 5/168* (2013.01); *B66B 13/303* (2013.01); *B66B 13/306* (2013.01); *E06B 3/82* (2013.01); *E05Y 2900/104* (2013.01)

(58) Field of Classification Search
CPC ..... B66B 13/30; B66B 13/303; E06B 5/168; E05Y 2900/104
See application file for complete search history.

(56) References Cited

U.S. PATENT DOCUMENTS

| | | | | |
|---|---|---|---|---|
| 1,770,267 | A | 7/1930 | Joseph | |
| 4,530,189 | A * | 7/1985 | Randall | B66B 13/303 109/77 |
| 5,139,111 | A | 8/1992 | Baumann et al. | |
| 5,156,237 | A | 10/1992 | Hayashi et al. | |
| 5,293,962 | A | 3/1994 | Pelvilain | |
| 6,145,630 | A | 11/2000 | Friedman et al. | |
| 6,202,798 | B1 * | 3/2001 | Friedman | B66B 13/08 187/325 |
| 7,152,906 | B1 | 12/2006 | Farrar et al. | |
| 8,869,474 | B2 | 10/2014 | Yoon | |
| 9,567,191 | B2 | 2/2017 | Fried et al. | |
| 9,650,230 | B2 | 5/2017 | Ketonen | |
| 9,745,172 | B2 * | 8/2017 | Gebhardt | B66B 11/0253 |

(Continued)

FOREIGN PATENT DOCUMENTS

| | | | |
|---|---|---|---|
| EP | 1044920 A2 * | 10/2000 | B66B 13/303 |
| EP | 2239223 | 10/2010 | |

(Continued)

OTHER PUBLICATIONS

"3M Aluminum Foil Tape 425-427," Technical Data 3M Industrial Adhesives and Tapes Division Jun. 2015 (2 pages).

(Continued)

*Primary Examiner* — Diem M Tran

(57) ABSTRACT

Some examples provide a fire-rated elevator door frame assembly with a flush transom. The transom includes a transom assembly. A fire-rated partition sits behind the transom on the hoistway side of the elevator doors. Architectural cladding can be applied to the front of the transom and to the front of the elevator doors giving the appearance that the flush transom extends high above the elevator doors.

12 Claims, 22 Drawing Sheets

(56) References Cited

U.S. PATENT DOCUMENTS

| | | | |
|---|---|---|---|
| 10,683,697 | B2 | 6/2020 | Clauson et al. |
| 2001/0023560 | A1 | 9/2001 | Degelsegger |
| 2003/0188498 | A1 | 10/2003 | Lewkowitz |
| 2010/0180507 | A1 | 7/2010 | Puchebner |
| 2011/0132698 | A1 | 6/2011 | Yu et al. |
| 2014/0008156 | A1 | 1/2014 | Umbaugh |
| 2014/0246276 | A1 | 9/2014 | Ketonen |
| 2017/0044811 | A1 | 2/2017 | Tsou et al. |
| 2019/0010017 | A1 | 1/2019 | Coldre |
| 2019/0177128 | A1 | 6/2019 | Ruan |
| 2019/0292843 | A1 | 9/2019 | Torrabias Cantal |
| 2019/0376335 | A1 | 12/2019 | Clauson et al. |

FOREIGN PATENT DOCUMENTS

| | | | | |
|---|---|---|---|---|
| JP | H08312261 | A | * | 11/1996 |
| JP | 2017072002 | A | * | 4/2017 |

OTHER PUBLICATIONS

"Anti-vandal doors," EN81-71 Category I, Wittur product descriptions May 2013 (2 pages).

"Fire-tested landing doors according to EN81-58," Lift-Report 39 Jahrg. (2013) p. 90 (1 page).

"H&B Elevator Entrance Profiles," PowerPoint Slide Deck available on H&B Elevators website URL <http://www.handbinc.com/downloads.html> May 2013 (9 pages).

"Landing doors compliant with DIN 18 091 and DIN EN 81 Part 58 with identical measurement specifications," Lift-Report 39. Jahrg. (2013) pp. 118-120 (3 pages).

"Pemko FB3000 Fire Glazing Tape," Architectural Door Accessories Pemko Manufacturing Co., an ASSA ABLOY Group Company 2017 (2 pages).

"Resistance to Fire Classification Report for Product Fires-CR-165-07-NURE," FIRES-CR-165-07-NURE, 2005 (40 pages).

"Stainless Steel & Fused Metal Elevator Door Skins," Forms + Surfaces Product Data Brochure 2013 available at URL <https://www.forms-surfaces.com/sites/default/files/product-data-sheet/SST_Fused_Metal_Elevator_Doorskins_PDS_0.pdf> (6 pages).

* cited by examiner

FIRE-RATED ELEVATOR DOOR FRAME AND TRANSOM FLUSH WITH DOOR

This application claims the benefit of U.S. Provisional Application No. 62/877,130, filed Jul. 22, 2019, the content of which is herein incorporated by reference in its entirety.

BACKGROUND

Building codes require builders to make elevators that meet particular safety standards. One such standard is fire rating. A fire rating indicates the amount of time that a particular item can withstand a fire with particular characteristics. For example, an elevator door with a 90-minute fire rating must be tested by being exposed to fire for at least 90 minutes. To pass the rating test, the fire must not spread beyond the elevator door in that 90 minutes. This type of test is rigorous and difficult to pass.

Elevator door frames can have a number of different configurations. One such configuration provides elevator doors with a transom above the doors. If an entrance does have a transom, the face of the transom can be flush with the vertical face of the door. Traditionally, fire-rated elevator entrances with a flush transom have two side jambs and a head jamb, with a fire-rated partition built around the side jambs and head jamb in much the same way as a common doorframe. In this configuration, the head jamb juts out in front of the elevator doors and flush transom.

SUMMARY

Some examples provide a transom assembly that includes a transom, a support rail, and a retainer bar. The support rail and retainer bar are configured to enclose a rear fire-rated partition offset from the top of the transom such that the fire-rated partition sits behind and slightly lower than the top of the transom. The rear fire-rated partition abuts a perpendicular shaft wall assembly perpendicularly, and the perpendicular shaft wall assembly abuts a shaft wall assembly such that a continuous fire-rated barrier is formed around the elevator frame.

The transom of the transom assembly comprises a front panel with a front face, a top surface, and interior lock ribs. The transom further comprises a rear panel with a rear face and Z-ribs. The lock ribs of the front panel and the Z-ribs of the rear panel secure the front panel to the rear panel. The transom further includes a heat-shielding panel attached to the rear face of the transom rear panel by a horizontal Z-bar retainer and at least one vertical Z-bar retainer.

The transom assembly further includes a support rail secured to the top of the transom. The support rail can be W-shaped, with a top flange, a vertical stabilizer segment, a horizontal support segment, and a bottom flange. In some examples, the top flange of the support rail is secured to the top surface of the front panel. The support rail is capable of laterally supporting a fire-rated rear panel.

The transom assembly further includes a retainer bar secured to the support rail. The retainer bar can be secured to the support rail by a fastener such as a nut and bolt. The retainer bar has a top flange, a bottom flange, and a vertical stabilizer segment extending between the top flange and the bottom flange.

An elongated horizontal enclosure pocket is formed between the vertical stabilizer segment of the support rail and the vertical stabilizer segment of the retainer bar. The elongated horizontal enclosure pocket is configured to receive a fire-rated rear partition.

The fire-rated rear partition is offset from the top of the transom assembly and secured to the transom assembly in the enclosure pocket. The rear partition is bounded by the vertical stabilizer segment of the support rail and the vertical stabilizer segment of the retainer bar.

Further examples include a method of assembling a fire-rated elevator door frame and transom. The method comprises assembling a transom assembly by securing a support rail to a top surface of a transom, the transom having a heat-shielding panel; releasably securing a retainer bar to the support rail; constructing an elevator door assembly by inserting the transom assembly into an elevator door frame; removing the retainer bar from the support rail; and inserting a rear partition onto the support rail. After inserting the rear partition, the retainer bar is replaced back into its original configuration on the support rail. In some examples, the retainer bar is secured to the support rail by a fastener. Performing the method secures the rear partition in place within the enclosure pocket between the vertical stabilizer segment of the support rail and the vertical stabilizer segment of the retainer bar. A barrier plate is placed on each end of the rear face of the rear partition to secure the rear partition to a perpendicular shaft wall assembly, thus forming a portion of a continuous fire-rated barrier.

Some examples of the technology provide an assembly for an elevator door and flush transom, the assembly comprising a transom assembly having a transom installed above at least one elevator door; a fire-rated rear partition offset from the top of the transom such that the fire-rated rear partition sits behind the transom assembly and behind a front face of the at least one elevator door; and architectural cladding installed on the top of the transom assembly. In some examples, the fire-rated rear partition is provided as a part of a continuous fire-rated barrier that includes the fire-rated rear partition, a perpendicular shaft wall assembly, and a shaft wall construction. In some examples, elevator door cladding is optionally applied to the at least one elevator door, the architectural cladding being flush with the elevator door cladding.

Some examples of the technology provide a fire-rated elevator door frame assembly comprising a transom assembly having a transom; a rear partition offset from the top of the transom; a front wall construction comprising a corridor partition and a shaft liner; and a perpendicular shaft wall assembly comprising a side partition and a perpendicular shaft liner. In some examples, the rear partition is parallel to the corridor partition, and the perpendicular shaft wall assembly is situated between the rear partition and the corridor partition, wherein the perpendicular shaft wall assembly is perpendicular to the rear partition and the corridor partition. In some examples, the perpendicular shaft wall assembly connects the rear partition and the corridor partition, creating a continuous fire-rated barrier.

Some examples provide a fire-rated shaft wall assembly comprising a fire-rated rear partition; a front wall construction comprising a corridor partition and a shaft liner; and a perpendicular shaft wall assembly comprising a side partition, a perpendicular shaft liner, and a fire-rated filler sandwiched between the side partition and the perpendicular shaft liner. In combination with the rear partition, the perpendicular shaft wall assembly forms a portion of a continuous fire-rated barrier. Additionally, the perpendicular shaft wall assembly is interlocked with the front wall construction via the side partition perpendicularly intersecting and contacting the corridor partition, the shaft liner, and the rear partition. The perpendicular shaft liner intersects the shaft liner and is also offset from and perpendicular to the rear partition, thus creating a door frame in which the elevator doors are at least partially surrounded by a continuous fire-rated barrier.

Some further examples provide a fire-rated elevator door assembly comprising elevator doors, side jambs on each side of the elevator doors, and a transom assembly seated above the elevator doors. The fire-rated elevator door assembly further includes a rear partition offset from the front face of the transom assembly and offset from the front face of the elevator doors; a front wall construction comprising a corridor partition and a shaft liner; and a fire-rated perpendicular shaft wall assembly comprising a side partition, a perpendicular shaft liner, and a fire-rated filler sandwiched between the side partition and the perpendicular shaft liner. In this example, the front wall construction and the perpendicular shaft wall assembly can meet in a perpendicular configuration over the top of the side jamb. The side jamb can flush with the top of the transom assembly, and the bottom of the perpendicular shaft wall assembly is substantially flush with the bottom of the rear partition. Further, the side partition has a cut-out in which a horizontal part of the cut-out sits on top of the side jamb, and a vertical part of the cut-out abuts the rear vertical face of the side jamb. A barrier plate substantially overlaps the perpendicular shaft wall assembly and a side end of the rear face of the rear partition, such that the barrier plate secures the rear partition to the perpendicular shaft wall assembly.

Some examples further include an elongate horizontal heat shield situated above the elevator door and below the bottom of the rear partition such that the heat shield juts out farther into the hoistway than the rear partition and the transom assembly.

Some examples include architectural cladding applied over the transom, elevator door cladding applied to the elevator door, wherein the architectural cladding is flush with the elevator door cladding.

Some further examples include a method of assembling a fire-rated elevator door assembly. The method includes assembling side jambs to a transom; installing the side jamb and transom assembly into a rough opening in the hoistway, assembling a front wall construction comprising a corridor partition and a shaft liner. The method further includes installing a perpendicular shaft wall assembly that is deeper than the transom assembly, the perpendicular shaft wall assembly overlapping a part of the top of the side jamb. The method further includes inserting a rear partition offset back from the transom such that the bottom of the rear partition is seated behind the transom and lower than the top of the transom and securing the rear partition to the transom assembly with a retainer bar. The method further includes securing the rear face of the rear partition to the hoistway-facing end of the perpendicular shaft wall assembly with a barrier plate and installing elevator door panels such that the transom front face above the doors is substantially flush with the elevator door front face. In this example, a continuous fire-rated barrier is formed around the elevator door frame. Some further examples include applying architectural cladding to the transom and applying cladding to the elevator doors, wherein the architectural cladding is flush with the cladding on the elevator doors.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

DETAILED DESCRIPTION

Figure 1:
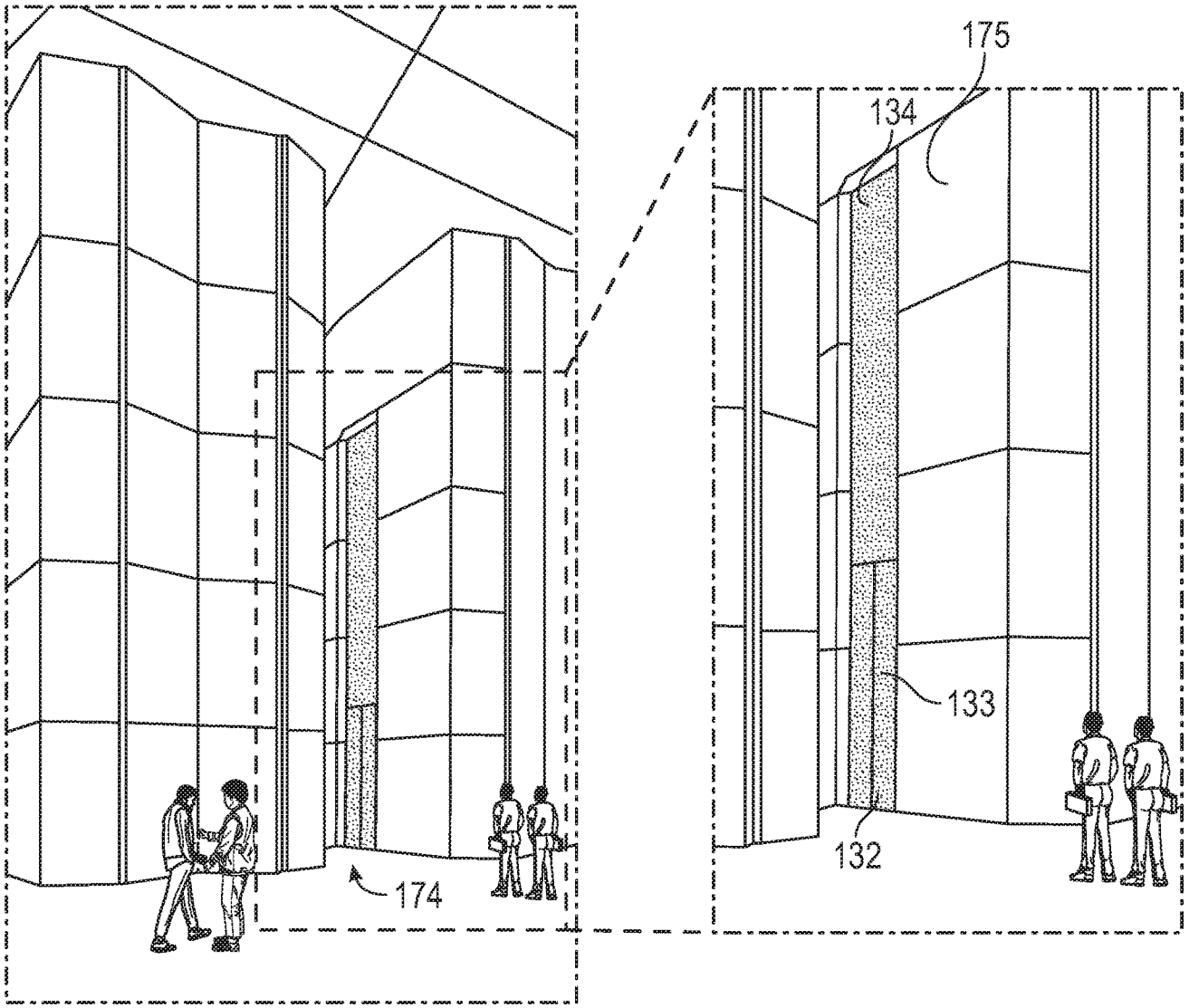
FIG. 1 is a perspective view of an elevator having a flush transom in the environment of an elevator bay according to some examples.

The present disclosure relates to a fire-rated elevator door frame construction with a flush transom. The disclosed technology provides a fire-rated construction without a head jamb. FIG. 1 shows a perspective view of an elevator door construction with a flush transom in the context of an elevator bay 174. In the construction shown in FIG. 1, elevator doors 132 having door cladding 133 are situated between architectural walls 175. Architectural walls 175 can be made of any desired material wall material, such as drywall, brick, stone, etc. An architectural transom cladding 134 extends above the elevator doors 132. The architectural transom cladding 134 is flush with the door cladding 133. In the example of FIG. 1, the architectural cladding 134 can be made of the same material as the door cladding 133. Aesthetically, the resulting structure appears as one continuous unit from the floor toward the ceiling. In some examples, the elevator doors 132 have a height of approximately 7 feet. The architectural cladding 134 can have a height that is much greater than the height of a conventional transom, and much greater than the height of the elevator doors 132. For example, the architectural cladding 134 can have a height that is two or three times the height of the elevator doors 132. In some examples, the architectural cladding 134 has a height greater than 10 feet, greater than 15 feet, greater than 20 feet, or greater than 25 feet. In some examples, the elevator door opening is between about 3 feet and about 4 feet wide. Other dimensions are possible, however, and are within the scope of the technology.

Fire-rated Elevator Door Construction with a Flush Transom (FIGS. 2-10)

Figure 2:
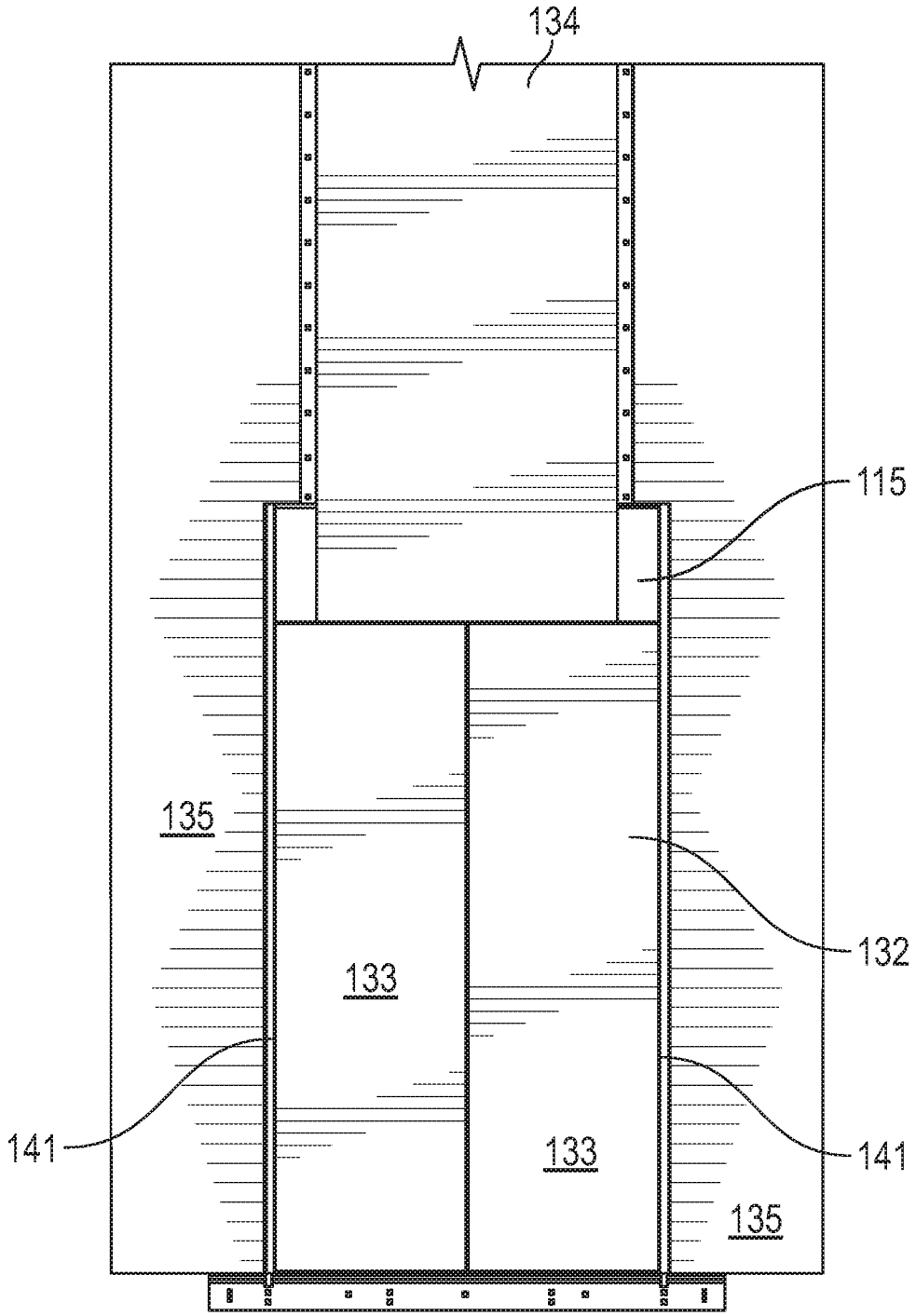
FIG. 2 is a front elevation of a fire-rated elevator door construction with a flush transom according to some examples.

FIG. 2 is a front elevation of a fire-rated elevator door frame construction with a flush transom according to some examples. This view is seen from the corridor or hallway side of the elevator doors. FIG. 2 shows the doors 132 with cladding 133, and the architectural cladding 134 extending above the doors 132. The cladding 133 is attached to the front face of the elevator doors 132. In FIG. 2, the architectural walls 175 have been removed, revealing a fire-rated corridor partition 135 that sits behind the architectural walls 175. The fire-rated corridor partition 135 forms a part of a fire-rated elevator door construction. In this example and other examples provided herein, the elevator door frame does not include a head jamb. Aesthetically, this enables the elevator doors and cladding structure to appear as though the transom is flush with the face of the elevator doors for any desired cladding height. In some examples, the height of the architectural cladding 134 is constrained only by the height limitations of the materials used to make the architectural cladding 134. For example, a galvanized sheet metal cladding may have a maximum height of 60 inches. In this case, multiple sheets of the galvanized sheet metal cladding can be placed one above the other to reach the desired height of the architectural cladding 134.

The top portion of FIG. 2 is shown as a cutaway view, because the height of the door frame construction can be as tall as desired. In the other figures throughout this disclosure, it should be understood that the height of the walls can be as tall as desired for any particular application of the technology.

Figure 3:
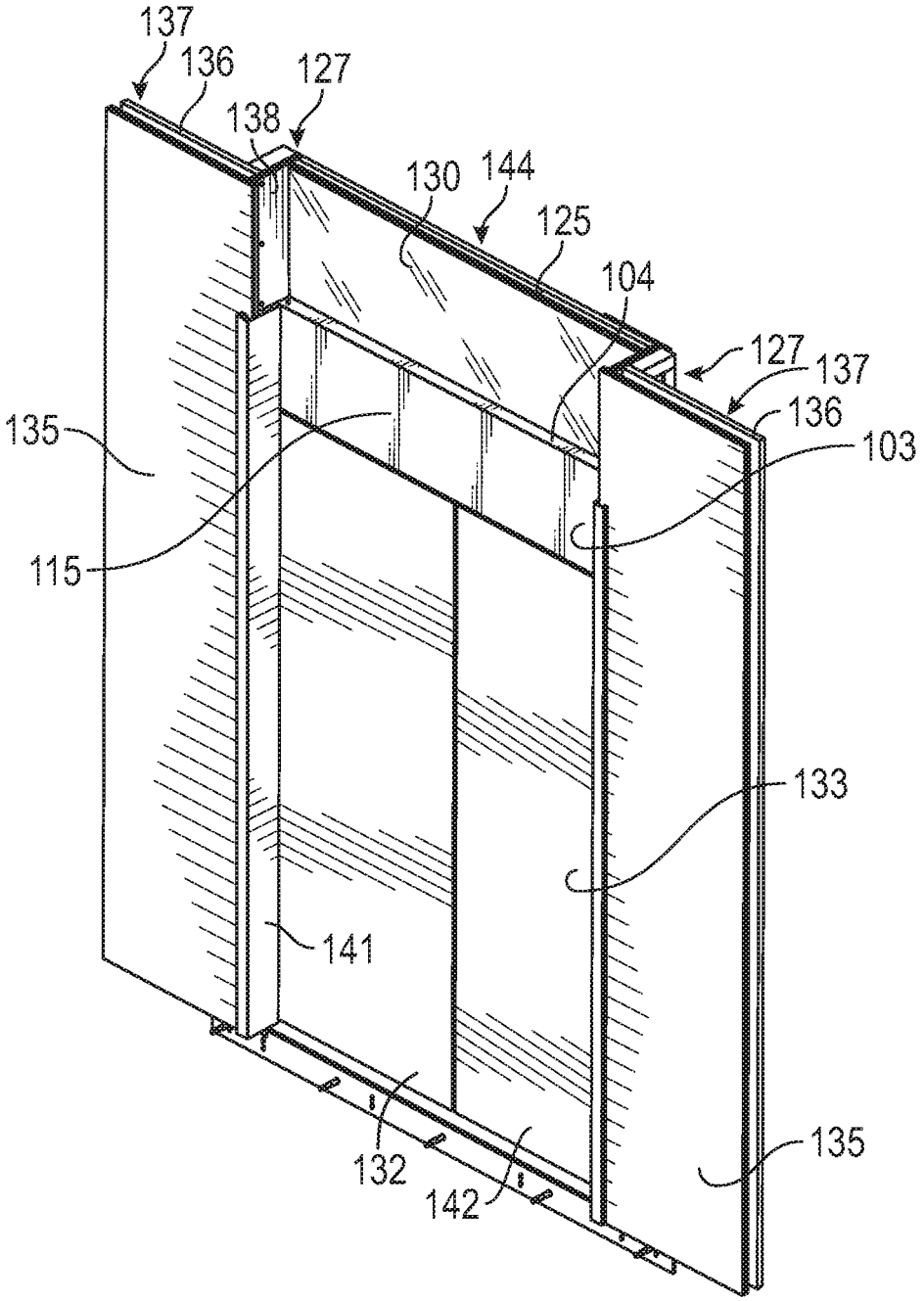
FIG. 3 is an orthographic projection of the corridor side of an elevator door construction with a flush transom according to some examples.
Figure 4:
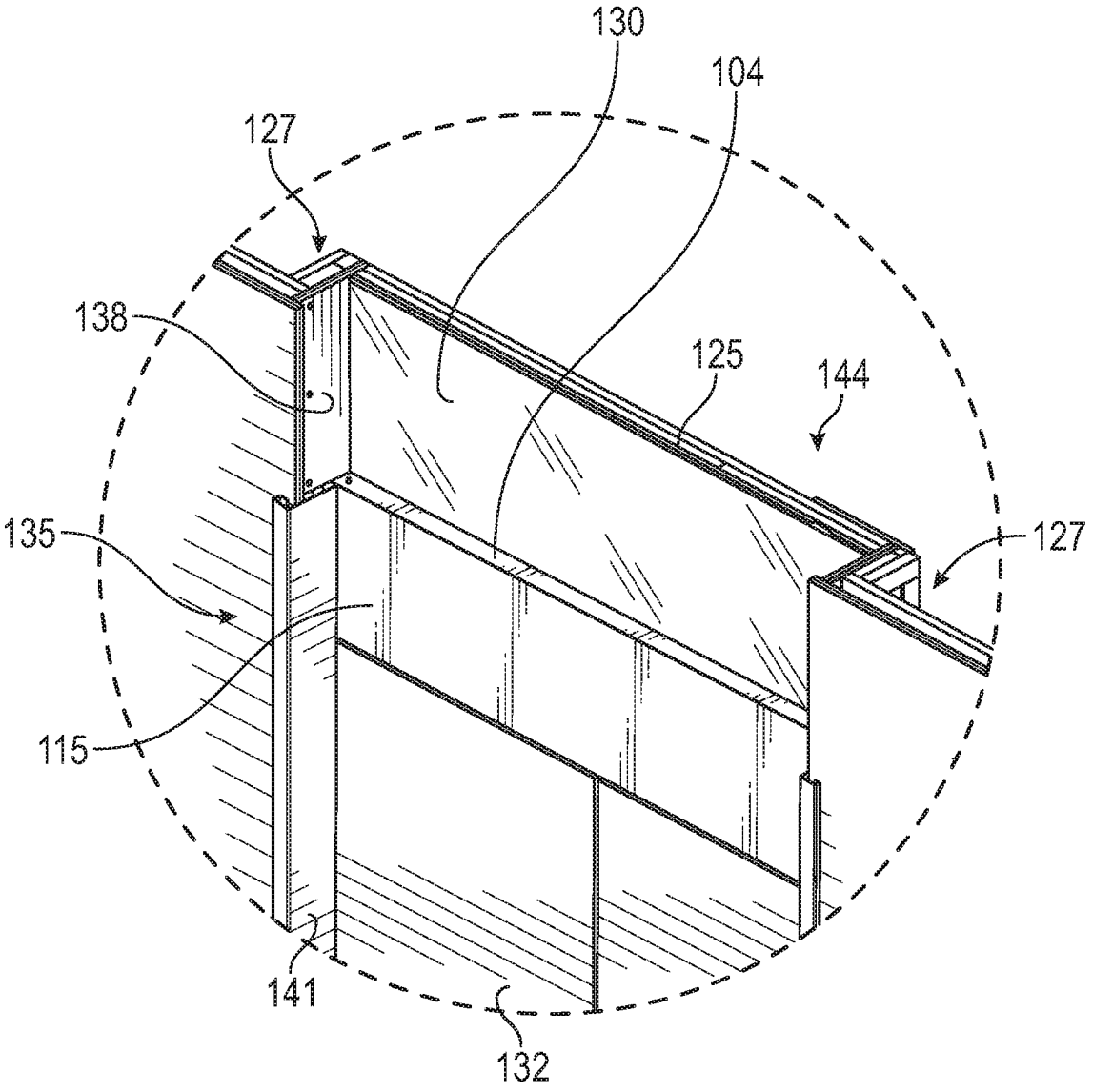
FIG. 4 is an enlarged view of the elevator door construction of FIG. 3.

The elevator door and frame with a fire-rated construction seen in FIGS. 2 through 4 includes the elevator doors 132 with door cladding 133. A transom 115 is covered by architectural cladding 134. The door cladding 133 and the architectural cladding 134 are flush with each other. In some examples, the door cladding 133 and the architectural cladding 134 are constructed from similar or identical materials, making the two structures appear seamless. In alternative examples, the door cladding 133 is not required. As described above, the architectural cladding 134 can have any desired height. The elevator doors 132 are framed by two side jambs 141. Each side jamb 141 encloses a corridor partition 135 and at least a portion of a perpendicular shaft wall assembly 127.

Figure 5:
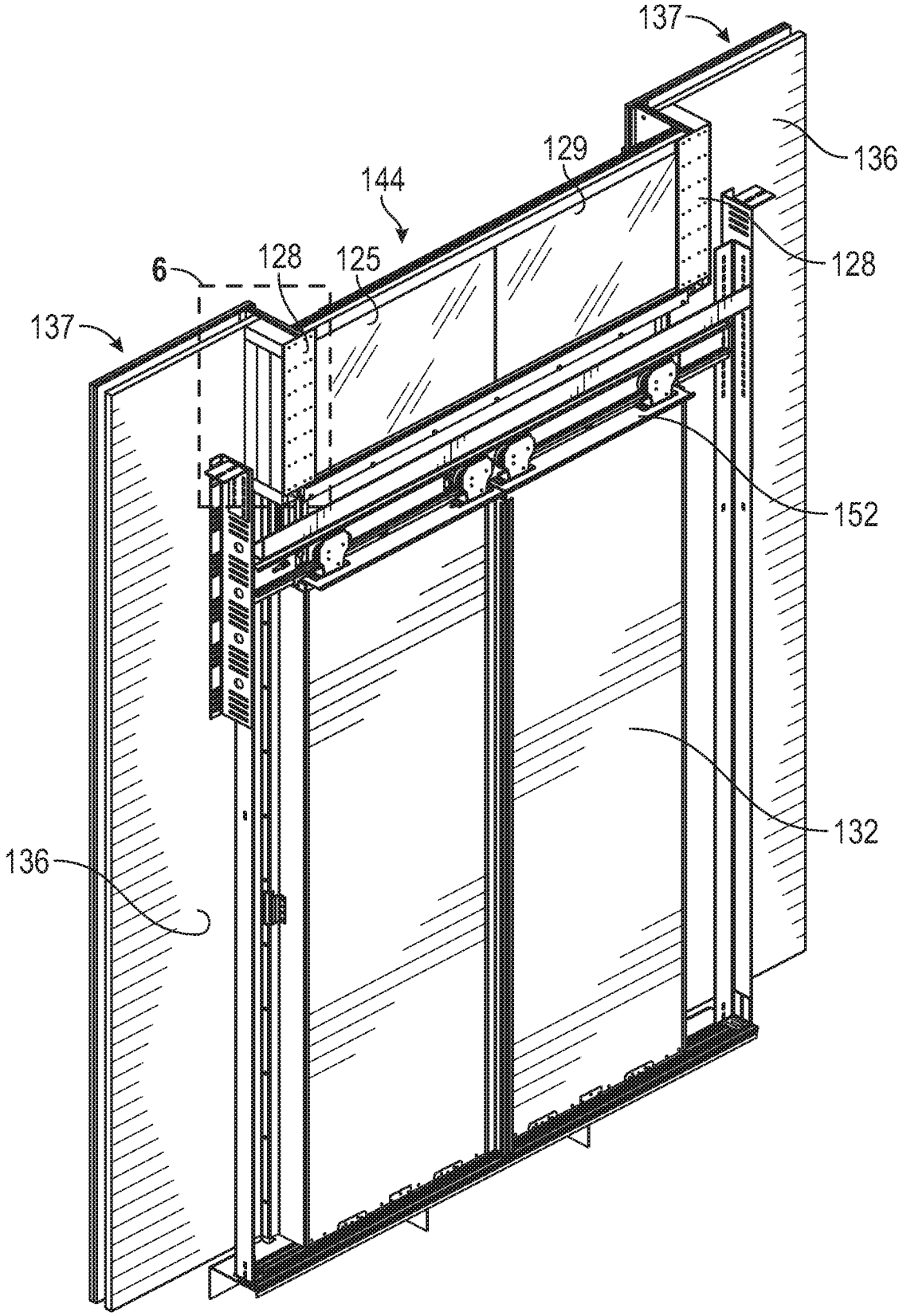
FIG. 5 is an orthographic projection of the hoistway side of the elevator door construction of FIG. 2.
Figure 6:
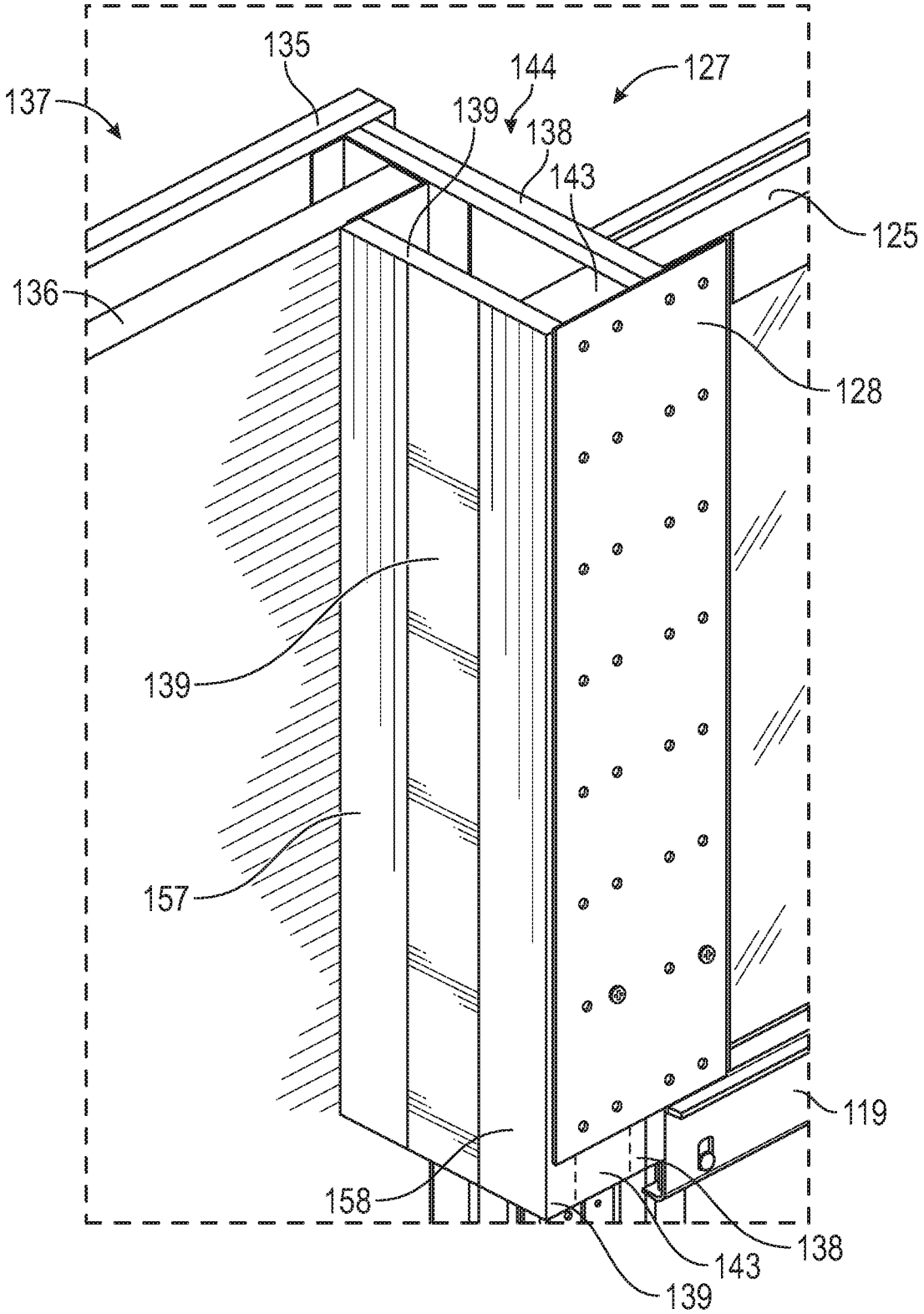
FIG. 6 is an enlarged view of FIG. 5 inside box 6, showing an upper corner of a continuous fire-rated barrier.
Figure 7:
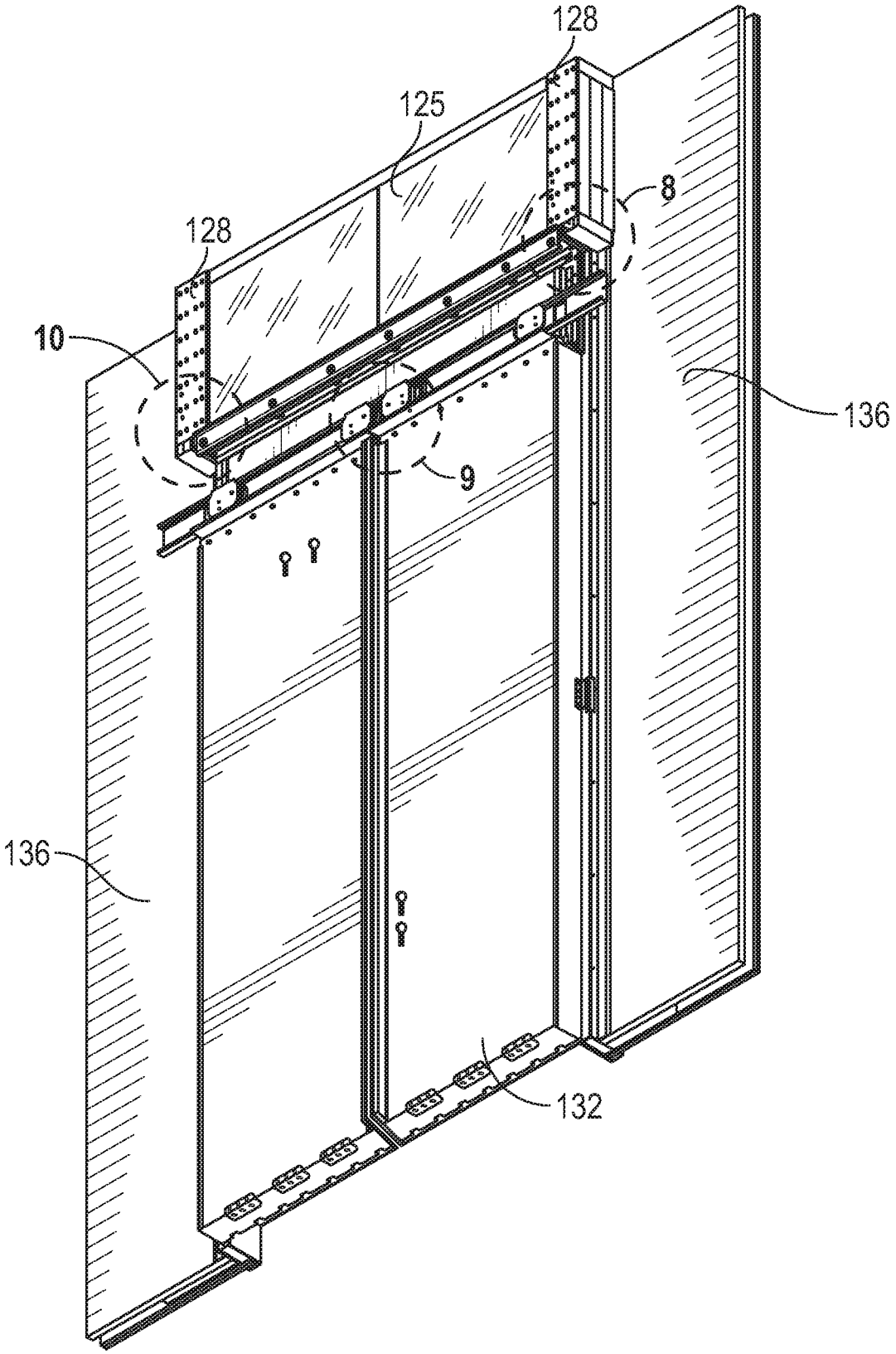
FIG. 7 is a second orthographic projection of the hoistway side of the elevator door construction of FIG. 2.
Figure 8:
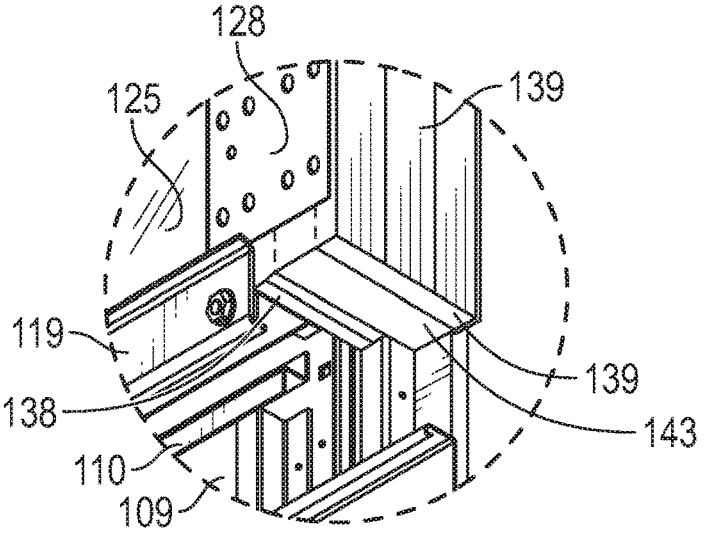
FIG. 8 is an enlarged view of FIG. 7 inside circle 8, showing the bottom end of a perpendicular shaft wall assembly.
Figure 9:
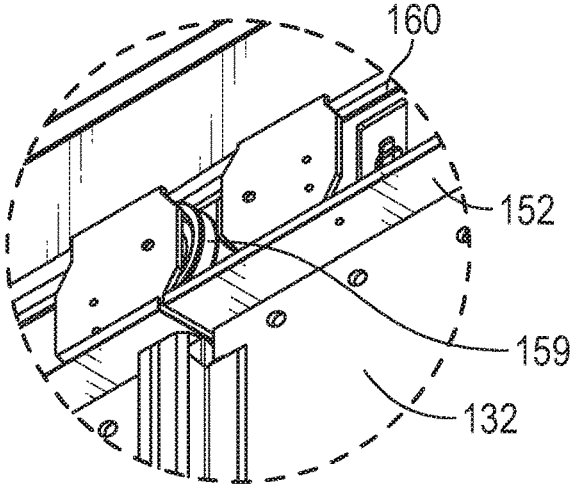
FIG. 9 is an enlarged view of FIG. 7 inside circle 9, showing a heat shield.
Figure 10:
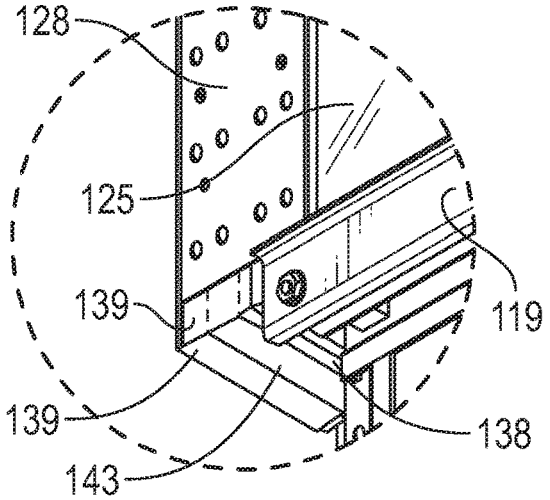
FIG. 10 is an enlarged view of FIG. 7 inside circle 10, showing a lower rear corner of a perpendicular shaft wall assembly for a continuous fire-rated barrier.
Figure 11:
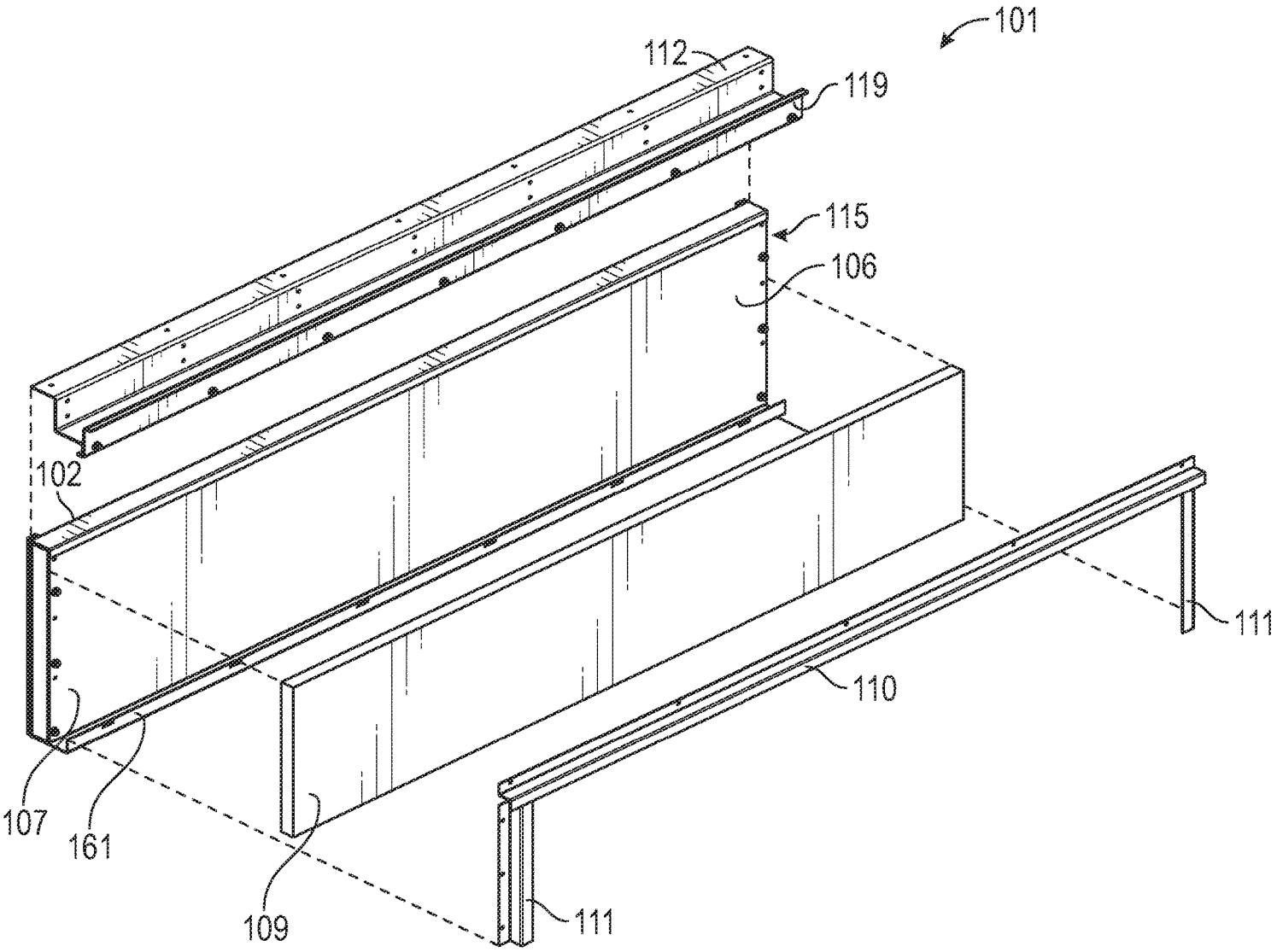
FIG. 11 is an exploded view of a transom assembly according to some examples.

FIG. 3 shows the elevator door and frame of FIG. 2 with the architectural cladding 134 removed, and FIG. 4 shows an enlarged view of a portion of FIG. 3. FIGS. 5 and 7 show the elevator assembly from the hoistway side of the elevator doors. FIG. 6 shows an enlarged view of FIG. 5, and FIGS. 8-10 show enlarged views of FIG. 7.

As can be seen in FIGS. 3 and 4, the elevator door frame includes a rear partition 125 having a front face 130. The transom 115 has a top surface 104 that juts out in front of the front face 130 of the rear partition 125. The front face 130 of the rear partition 125 is set back from the front face 103 of the transom 115, and also is set back from the corridor partition 135.

The shaft wall construction 137 comprises the corridor partition 135 and a shaft liner 136. The shaft wall construction 137 is interleaved with the perpendicular shaft wall assembly 127. In some examples, the shaft wall construction 137 is a fire-rated non-load-bearing wall that conforms to Underwriters Laboratory standard U415 System B with a 2-hour fire rating. In some examples, the shaft wall construction 137 can be made of a material such as gypsum or drywall. In some examples, the shaft wall construction 137 can be concrete or masonry.

As seen in FIGS. 5 and 6, a continuous fire-rated barrier 144 is formed around the elevator doors 132. The fire-rated barrier 144 comprises a rear partition 125, perpendicular shaft wall assemblies 127 on each side of the rear partition 125, and a shaft wall construction 137. The perpendicular shaft wall assembly 127 connects the corridor partition 135 and the rear partition 125 on the left and right sides of the elevator doors. J-runners 157 and 158 are used to secure the rear partition 125, perpendicular shaft wall assembly 127, and shaft wall construction 137 together. For the sake of simplicity, fasteners, such as screws or bolts, are omitted from the various figures. It should be understood that the J-runners and the various fire-rated partitions would be secured together with suitable fasteners.

The elevator doors 132 are protected by a heat shield 152 that sits between the elevator doors 132 and the hanger rollers 159 on bracket 160. The heat shield 152 provides further heat protection for the various parts of the elevator doors.

In one aspect, a fire-rated shaft wall assembly comprises a fire-rated rear partition 125; a front wall construction 137 comprising a corridor partition 135 and a shaft liner 136; a perpendicular shaft wall assembly 127 comprising a side partition 138, a perpendicular shaft liner 139, and a fire-rated filler 143 sandwiched between the side partition 138 and the perpendicular shaft liner 139, wherein, in combination with the rear partition 125, the perpendicular shaft wall assembly 127 forms a portion of a continuous fire-rated barrier 144; wherein the perpendicular shaft wall assembly 127 is interlocked with the front wall construction 137 via the side partition 138 perpendicularly intersecting and contacting the corridor partition 135, the shaft liner 136, and the rear partition 125; wherein the perpendicular shaft liner 139 intersects the shaft liner 136 and is also offset from and perpendicular to the rear partition 125; and wherein the elevator doors 132 are at least partially surrounded by a continuous fire-rated barrier 144.

In one aspect, a fire-rated elevator door frame assembly comprises a transom assembly 101; a rear partition 125 offset from the top surface 104 of the transom assembly 101; a front wall construction 137 comprising a corridor partition 135 and a shaft liner 136; a perpendicular shaft wall assembly 127 comprising a side partition 138 and a perpendicular shaft liner 139; wherein the rear partition 125 is parallel to the corridor partition 135; wherein the perpendicular shaft wall assembly 127 situated between the rear partition 125 and the corridor partition 135 and the perpendicular shaft wall assembly 127 separates the rear partition 125 from the corridor partition 135; wherein the perpendicular shaft wall assembly 127 is perpendicular to the rear partition 125 and the corridor partition 135; and wherein the elevator doors are at least partially surrounded by a continuous fire-rated barrier 144.

One aspect provides a fire-rated elevator door assembly comprising elevator doors 132, side jambs 141 on each side of the elevator doors 132; a transom assembly 101 seated above the elevator doors 132; a rear partition 125 offset from the front face 103 of the transom assembly 101 and offset from the front face of the elevator doors 132; a front wall construction 137 comprising a corridor partition 135 and a shaft liner 136; a fire-rated perpendicular shaft wall assembly 127 comprising a side partition 138, a perpendicular shaft liner 139, and a fire-rated filler 143 sandwiched between the side partition 138 and the perpendicular shaft liner 139; wherein the front wall construction 137 and the perpendicular shaft wall assembly 127 meet in a perpendicular configuration over the top of the side jamb 141; wherein the side jamb 141 is flush with the top surface 104 of the transom assembly 101; wherein the side partition 138 has a cutout 146 in which a horizontal part 147 of the cutout 146 sits on the top 145 of the side jamb 141, and a vertical part 148 of the cutout 146 abuts the rear vertical face 148 of the side jamb 141; a barrier plate 128 that substantially overlaps the perpendicular shaft wall assembly 127 and the rear surface 129 of the rear partition 125, wherein the barrier plate 128 secures the rear partition 125 to the perpendicular shaft wall assembly 127; an elongate horizontal heat shield 152 situated above the elevator door 132 and below the bottom of the rear partition 125 such that the heat shield 152 juts out farther into the hoistway than the rear partition 125 and the transom assembly 101, architectural cladding 134 above the top surface 104 of the transom assembly 101, elevator door cladding 133 applied to the elevator door 132, wherein the architectural cladding 134 is flush with the elevator door cladding 133.

Transom Assembly (FIGS. 11-18)

Figure 16:
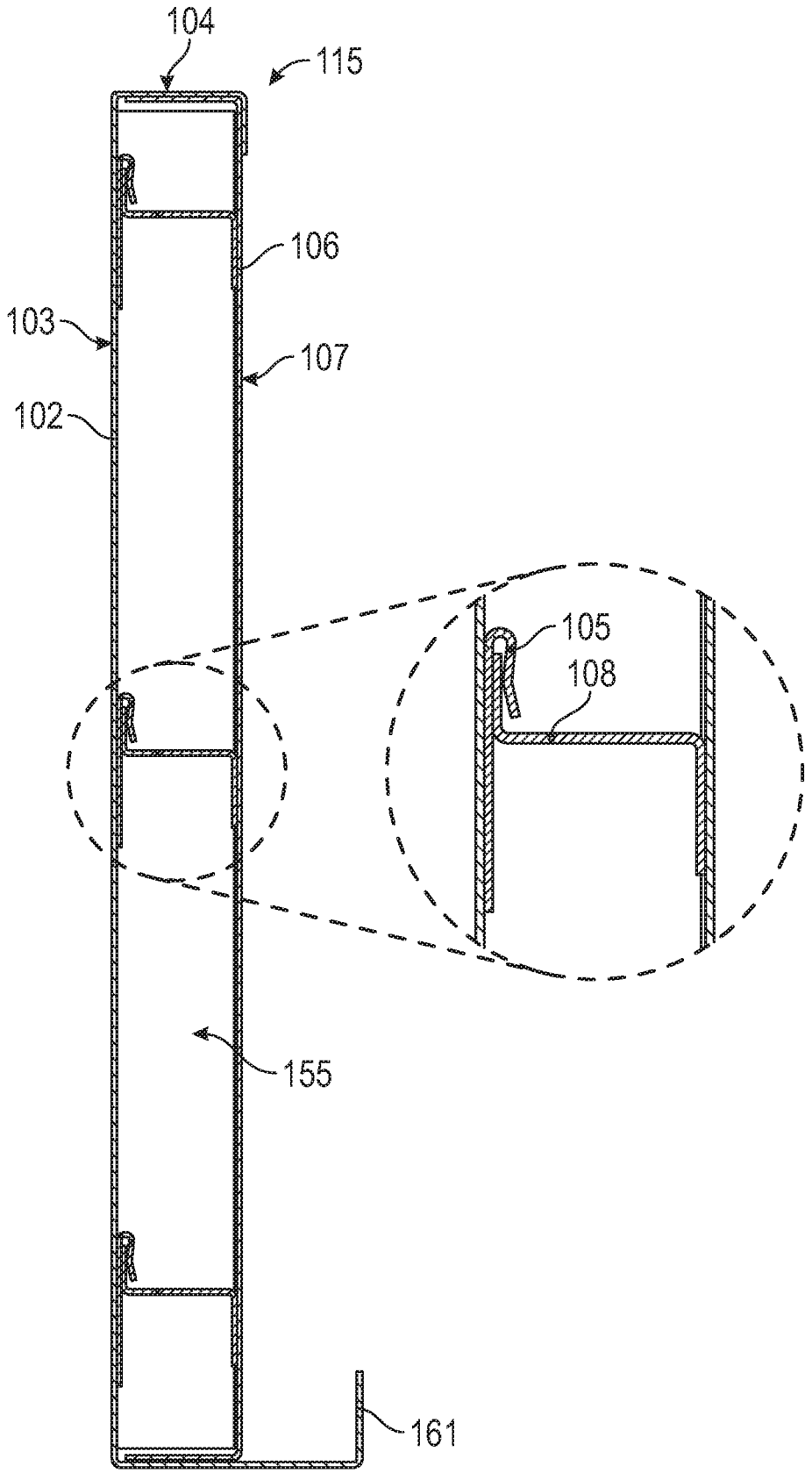
FIG. 16 is a cross-sectional view of the transom according to some examples.
Figure 17:
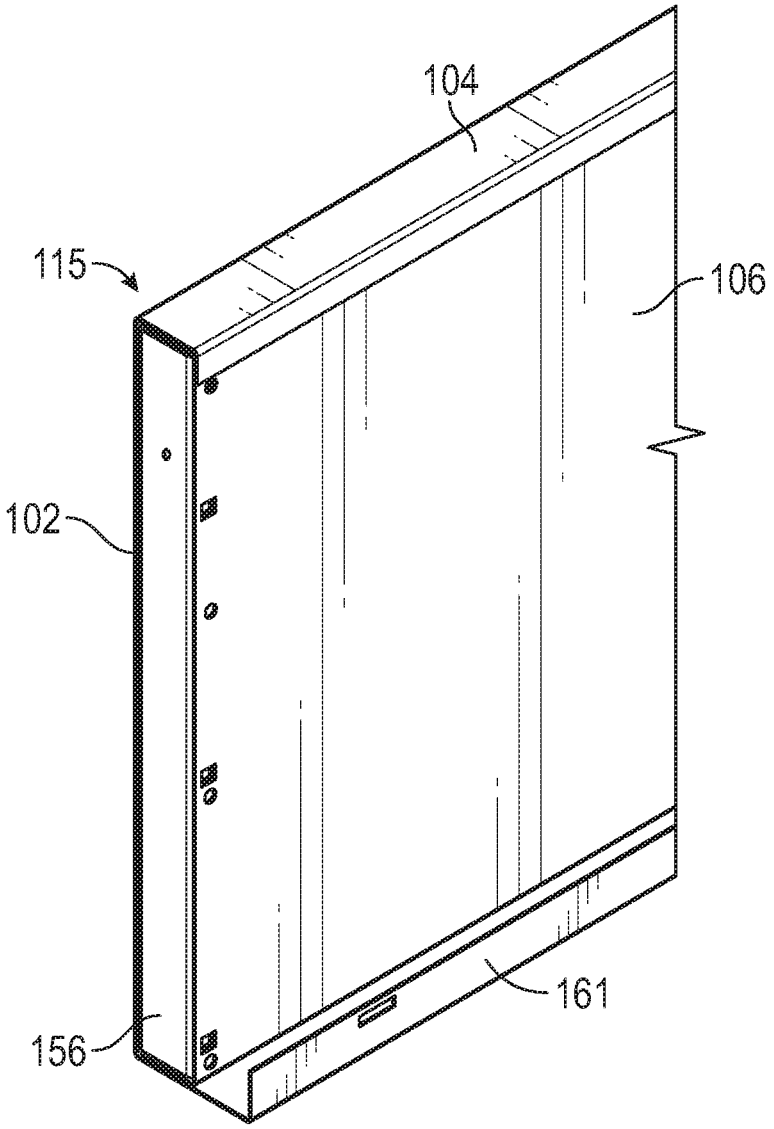
FIG. 17 is an assembled view of an elevator transom of FIG. 16 according to some examples.
Figure 18:
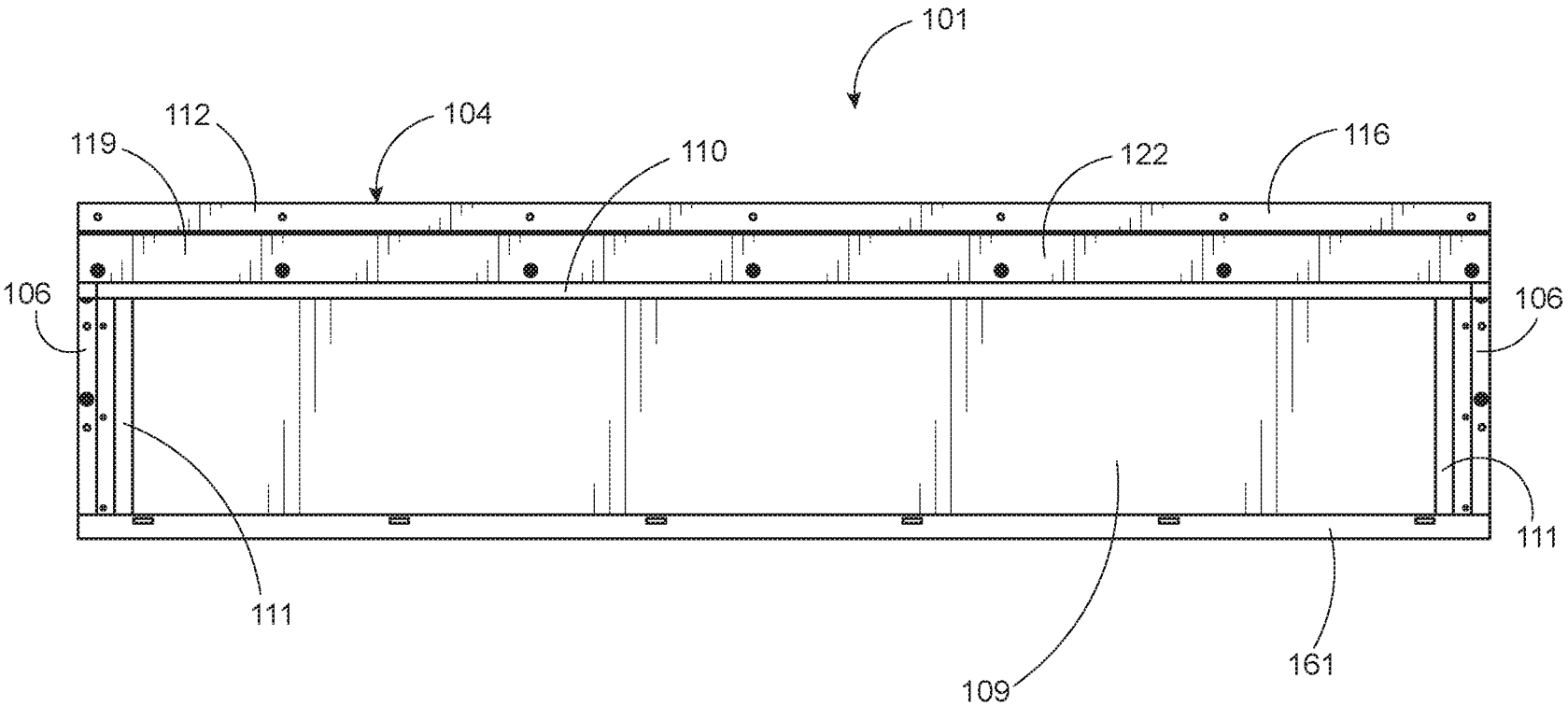
FIG. 18 is a rear elevational view of the transom assembly of FIG. 12.

FIGS. 11-18 show one example of a transom assembly according to some examples. The transom assembly 101 includes a transom 115. The transom 115 comprises a front panel 102 having a front face 103 and a rear panel 106 having a rear face 107. The front panel 102 has interior lock ribs 105, and the rear panel 106 has Z-ribs 108. As seen in FIG. 16, the interior lock ribs 105 mate with the Z-ribs 108 to secure the front panel 102 to the rear panel 106. The front panel 102 and the rear panel 106 enclose a void 155. An end channel 156 encloses each side of the transom 115. The front panel 102 also includes a rear lip 161 that encloses the rear face 107 of the rear panel 106. A heat-shielding panel 109 is secured to the rear face 107 of the rear panel 106 by one or more horizontal Z-bars 110 and one or more vertical Z-bars 111. The heat-shielding panel can be made of gypsum, drywall, or other fire-rated material. The heat-shielding panel 109 sits inside of the rear lip 161 of the front panel 102.

Figure 14:
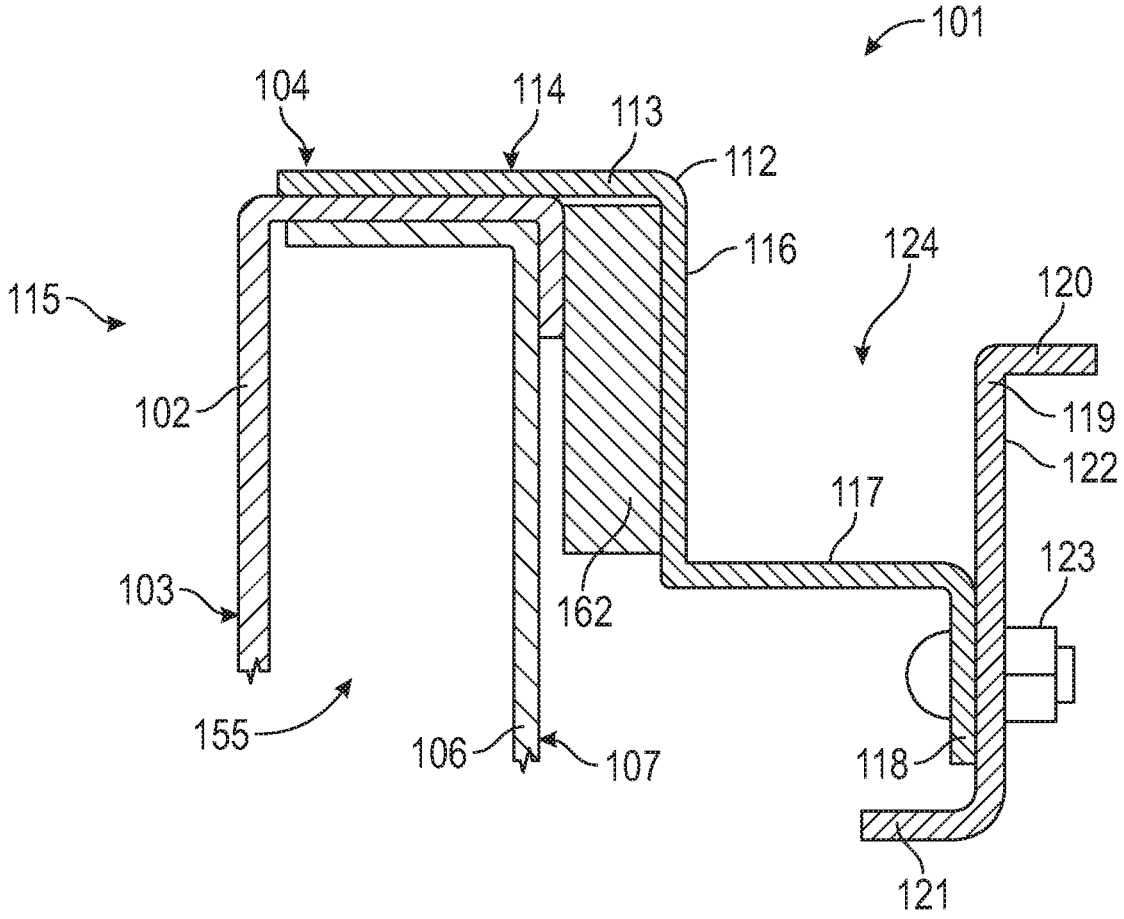
FIG. 14 is a cross-sectional view of an upper portion of the transom assembly of FIG. 12.
Figure 15A:
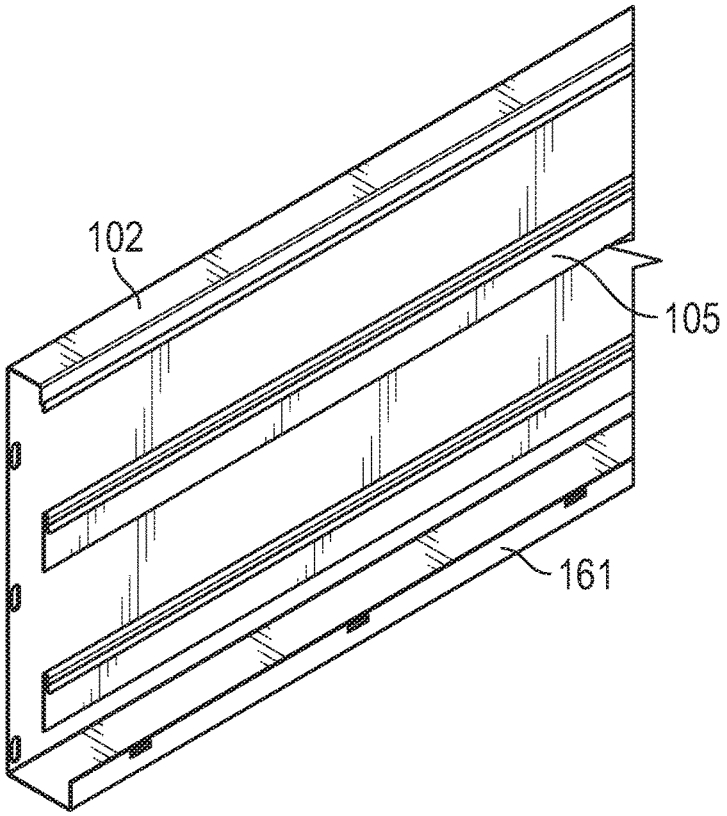
FIG. 15A is a partial view of a transom front panel according to some examples.
Figure 15B:
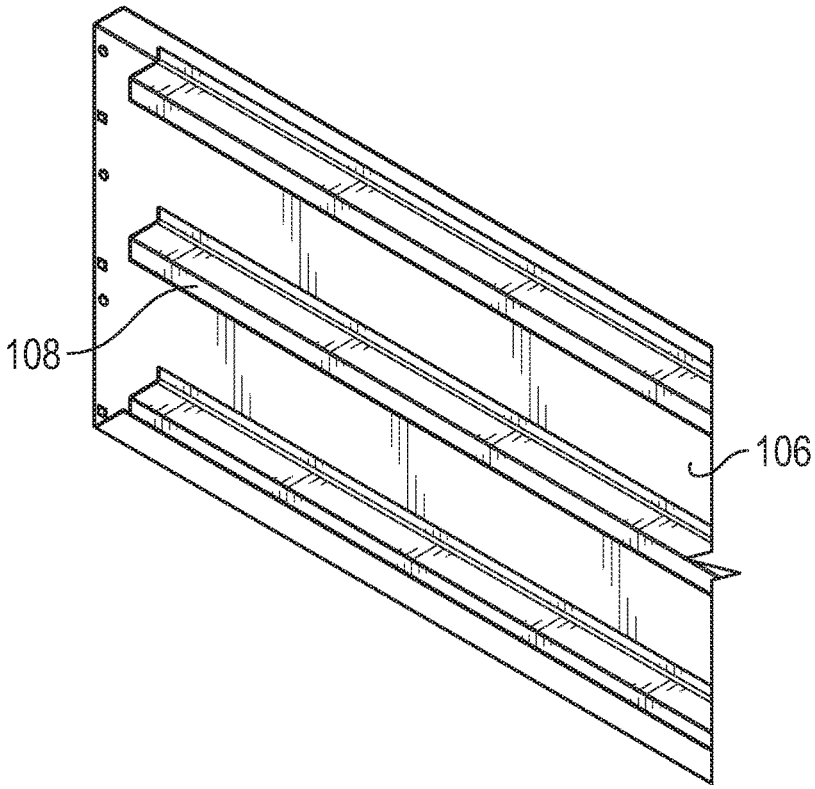
FIG. 15B is a partial view of a transom rear panel according to some examples.

The transom assembly 101 further includes a support rail 112 and a retainer bar 119. The retainer bar 119 is secured to the support rail 112 by a fastener, such as a bolt 123 (shown in FIG. 14). In some examples, the support rail 112 has four segments: a top flange 113 with a top surface 114, a vertical stabilizer segment 116, a horizontal support segment 117, and a bottom flange 118. In the example of FIG. 14, the top flange 113 of the support rail 112 is secured to the top of the front panel 102, such that the top flange 113 defines the top surface 104 of the transom assembly 101. For example, the top flange 113 can be secured to the front panel 102 using a plug weld, spot weld, or tack weld. Optionally, a spacer 162 can be provided between the transom 115 and the vertical stabilizer segment 116 of the support rail 112.

Figure 12:
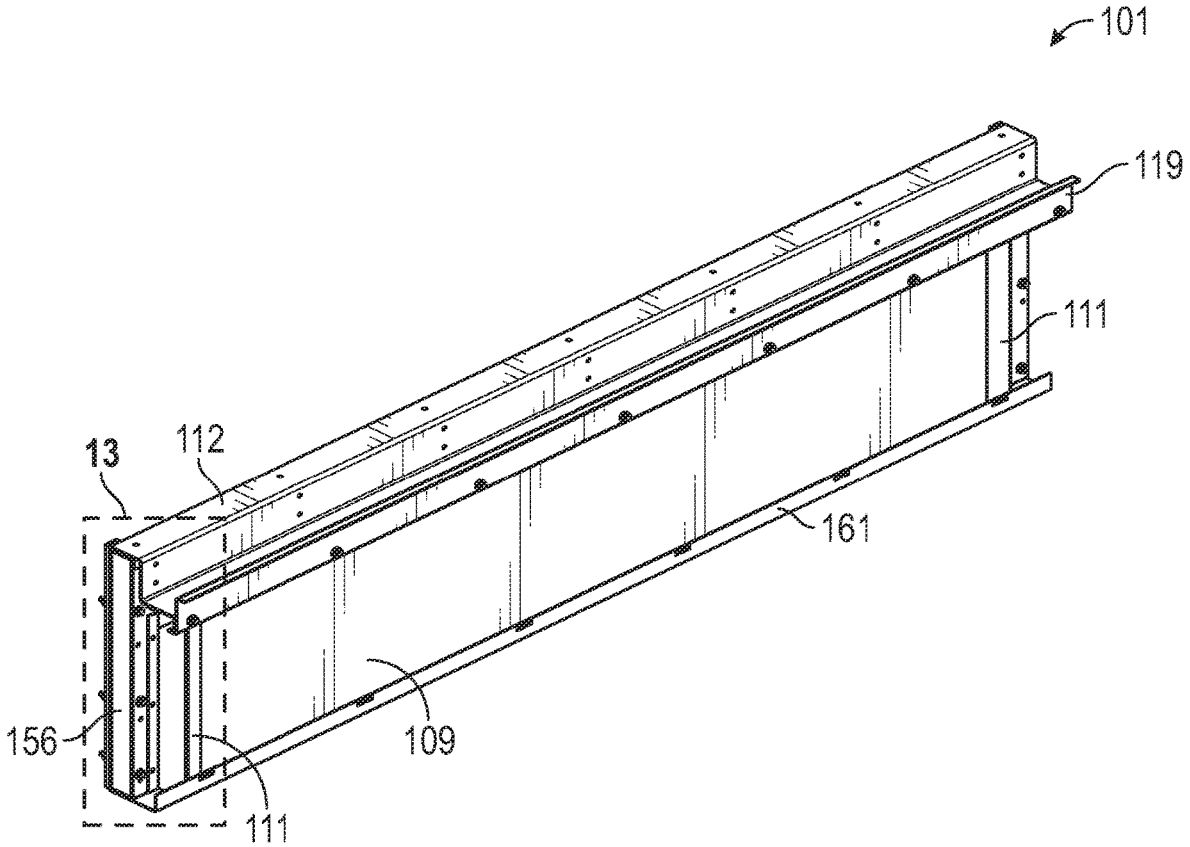
FIG. 12 is an assembled view of the transom assembly of FIG. 11.
Figure 13:
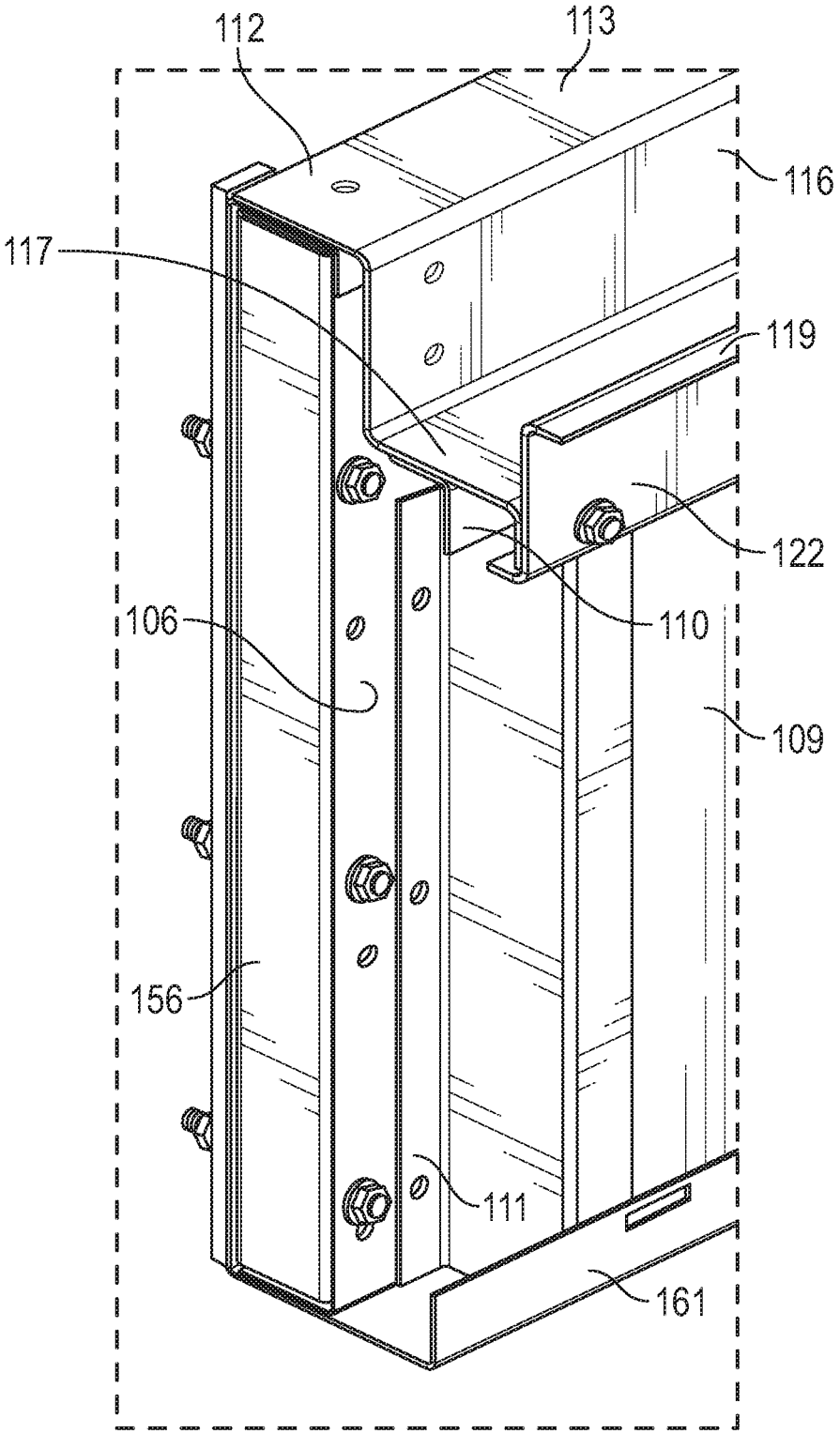
FIG. 13 is an enlarged view of FIG. 12 inside box 13.

Further referring to FIG. 14, in some examples, the retainer bar 119 is a Z-bar having three segments: a top flange 120, a bottom flange 121, and a vertical stabilizer segment 122 extending between the top flange 120 and the bottom flange 121. The bottom flange 118 of the support rail 112 is secured to the vertical stabilizer segment 122 of the retainer bar 119 by a fastener, such as a nut and bolt 123. Together the support rail 112 and the retainer bar 119 form an elongated horizontal enclosure pocket 124, as seen in FIG. 12. As will be described below in relation to FIGS. 19-22, the enclosure pocket 124 is capable of laterally supporting a fire-rated partition as part of a fire-rated elevator door frame construction.

Fire-Rated Shaft Wall Assembly (FIGS. 19-22)

Figure 19:
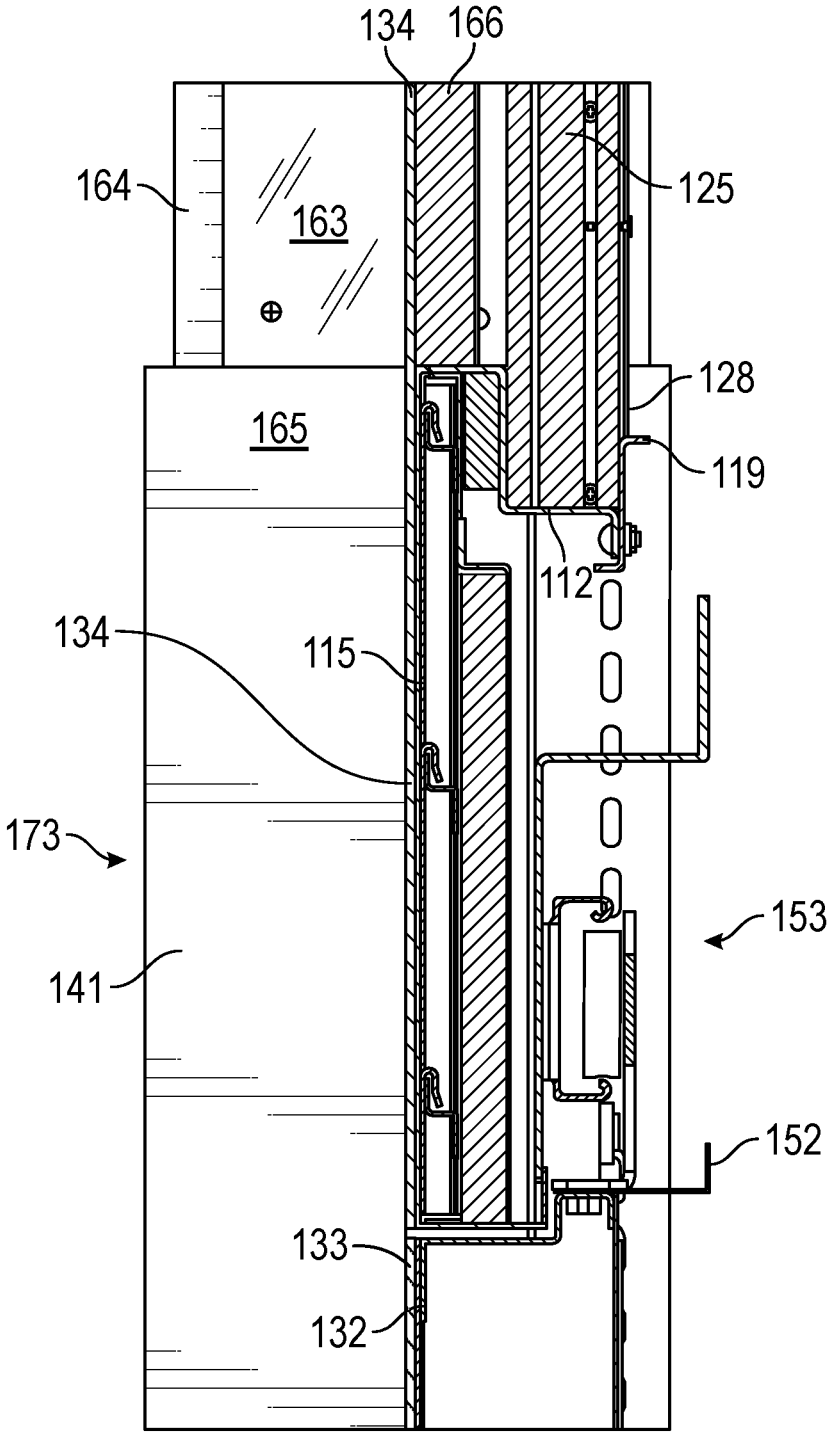
FIG. 19 is a cross-sectional view of a fire-rated elevator door construction with a flush transom according to some examples.

FIGS. 19-22 show an assembly for an offset fire-rated elevator transom, comprising the transom assembly 101 of FIGS. 11-18 in combination with a rear partition 125, which is offset from the top 104 of the transom assembly 101 and secured to the transom assembly 101 in an enclosure pocket 124 (shown in FIG. 14) bounded by the vertical stabilizer segment 116 of the support rail 112 and the vertical stabilizer segment 122 of the retainer bar 119. As seen in FIG. 19, the elevator door frame assembly has a hoistway side 153 and a corridor side 173.

FIG. 19 further shows an assembly for an elevator door flush with a transom. The assembly comprises the transom assembly 101; a rear partition 125 offset from the top surface 104 of the transom assembly 101; at least one elevator door 132 with elevator door cladding 133; and architectural cladding 134 installed over the top surface 104 of the transom assembly 101, the architectural cladding 134 being flush with the elevator door cladding 133. A wall build-out segment 166 can be added above the top of the transom assembly 104.

Figure 20A:
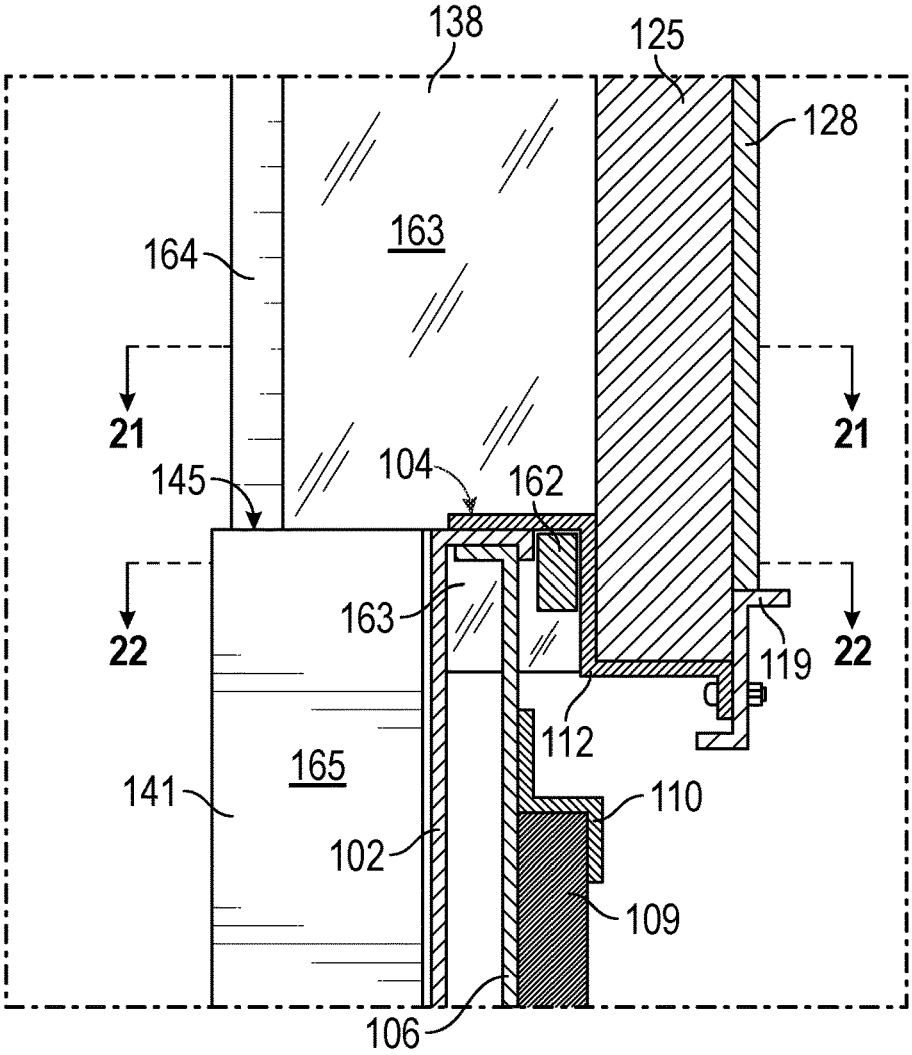
FIG. 20A is the cross-sectional view of FIG. 19 with some elements removed to reveal additional details.
Figure 20B:
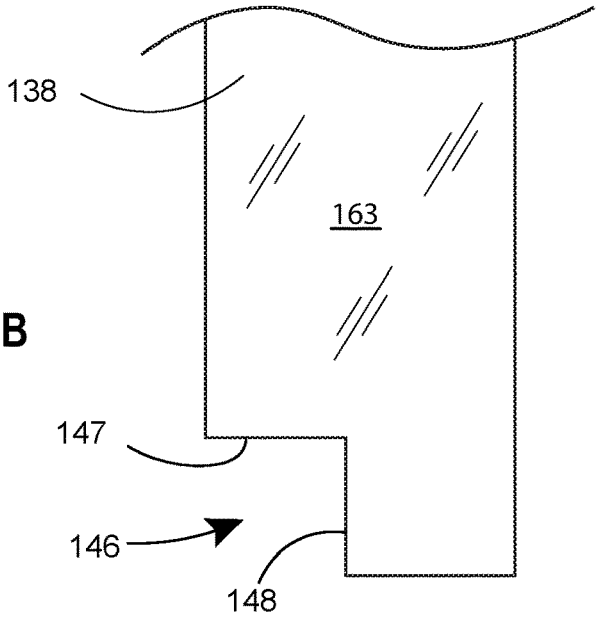
FIG. 20B is an elevational view of a side partition according to some examples.

FIG. 20A shows the fire-rated barrier with some structural elements removed to show the interconnections between different parts. Similar to FIG. 4, FIG. 20A shows the construction with the architectural cladding removed. This view shows that the inward-facing wall 163 of the side partition 138. The side partition 138 includes a cutout 146 (seen in FIG. 20B) that has a horizontal edge 147 and a vertical edge 148. The horizontal edge 147 can sit on the top edge 145 of the side jamb 141, and the vertical edge 148 abuts the rear vertical face 149 of the side jamb 141.

Figure 21:
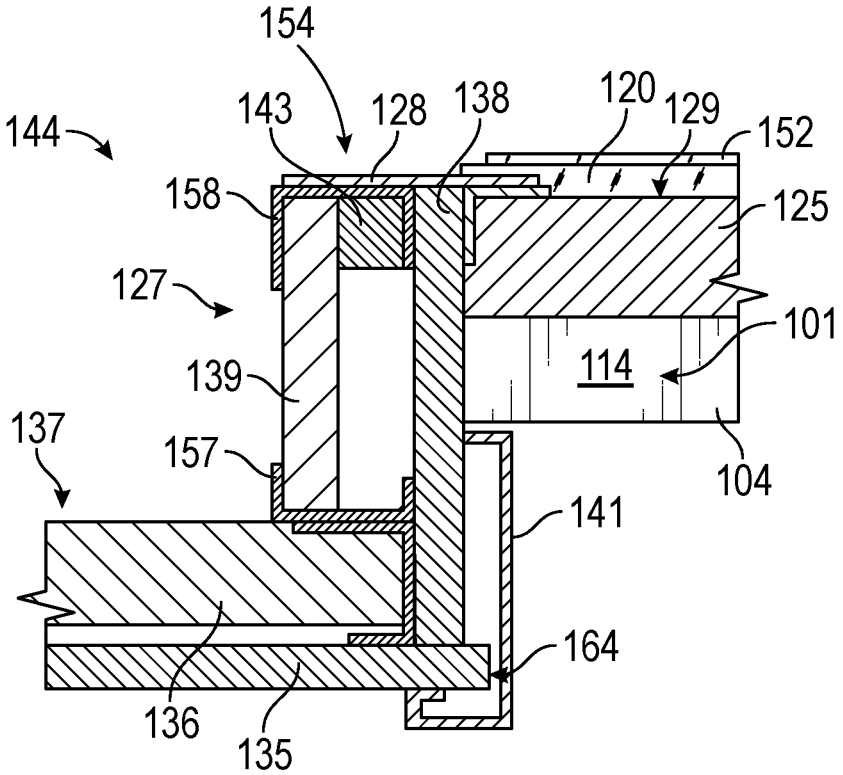
FIG. 21 is a cross-sectional view of the fire-rated elevator door construction with a flush transom of FIG. 20A along line 21-21 according to some examples.
Figure 22:
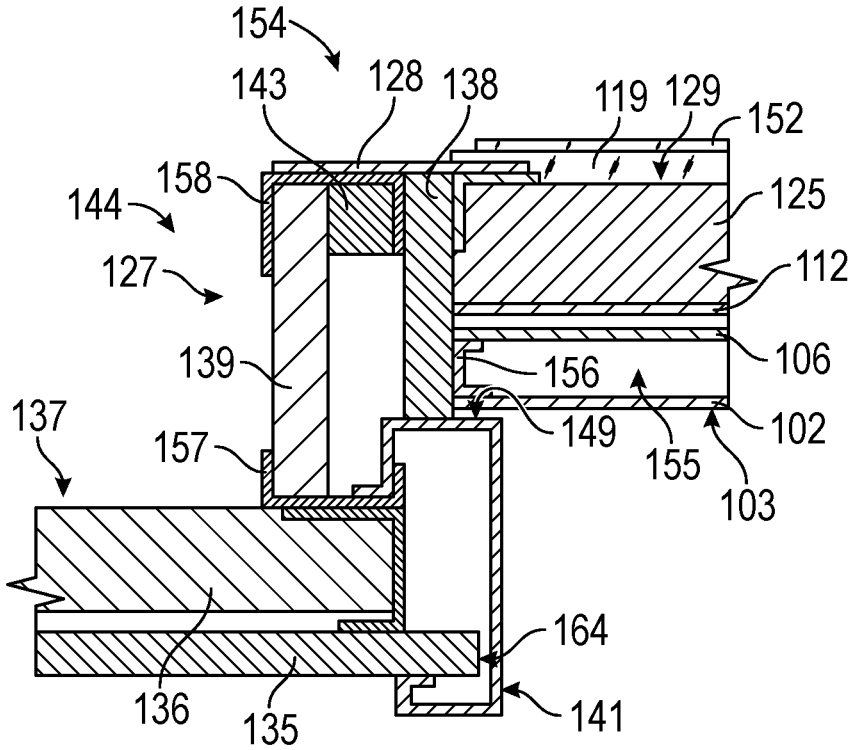
FIG. 22 is a cross-sectional view of the fire-rated elevator door construction with a flush transom of FIG. 20A along line 22-22 according to some examples.
Figure 23:
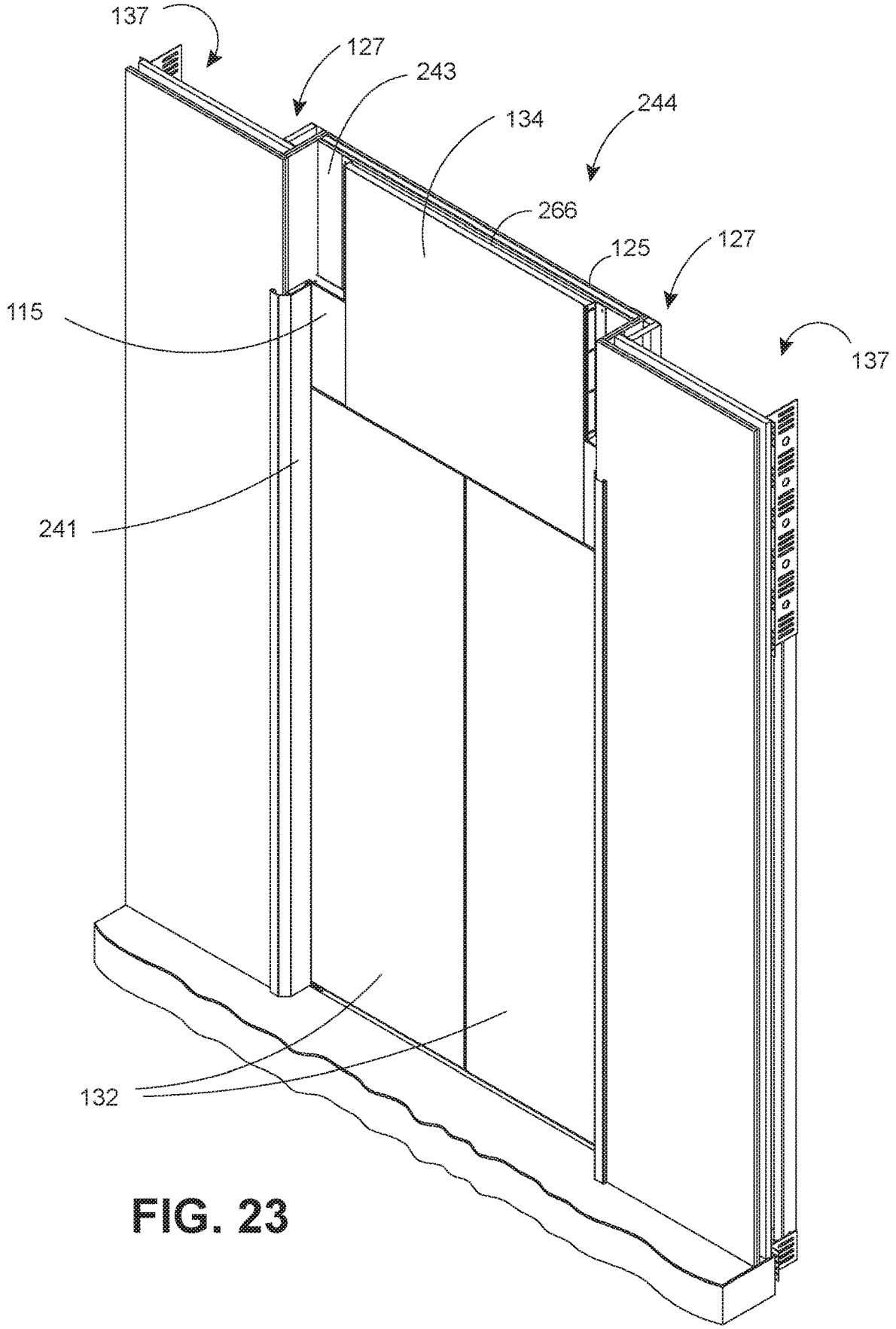
FIG. 23 is an orthographic projection of an alternative fire-rated elevator door construction with a flush transom according to some examples.

FIGS. 21 and 22 show a continuous fire-rated barrier 144. Although FIGS. 21 and 22 only show the left side of the door frame, it should be understood that the elevator door frame is symmetrical, and the right side of the door frame is a mirror image of the left side. The fire-rated barrier 144 comprises a rear partition 125, a perpendicular shaft wall assembly 127 abutting the rear partition 125, and a shaft wall construction 137 interleaved with the perpendicular shaft wall assembly 127. The perpendicular shaft wall assembly 127 and the shaft wall construction 137 meet at the side jamb 141. A barrier plate 128 secures the rear partition 125 to the perpendicular shaft wall assembly 127. The shaft wall construction comprises a corridor partition 135 and a shaft liner 136. The perpendicular shaft wall assembly comprises a perpendicular shaft liner 139, a side partition 138, and a fire-rated filler 143 sandwiched between the perpendicular shaft liner 139 and the side partition 138.

Elevator Door with a Flush Transom and Architectural Cladding (FIGS. 23-26)

An alternative example of an elevator door is shown in relation to FIGS. 23-26. A continuous fire-rated barrier 244 is formed around the elevator doors 132. Similar to the examples provided above, the fire-rated barrier 244 comprises a perpendicular shaft wall assembly 127 abutting a rear partition 125, and a shaft wall construction 137 interleaved with the perpendicular shaft wall assembly 127. The perpendicular shaft wall assembly 127 and the shaft wall construction 137 meet at the side jamb 241. As in FIGS. 5-6, a barrier plate 128 secures the rear partition 125 to the perpendicular shaft wall assembly 127. Optionally, a fire-rated filler 243 can be provided to fill out the depth of the rear partition 125.

Figure 24:
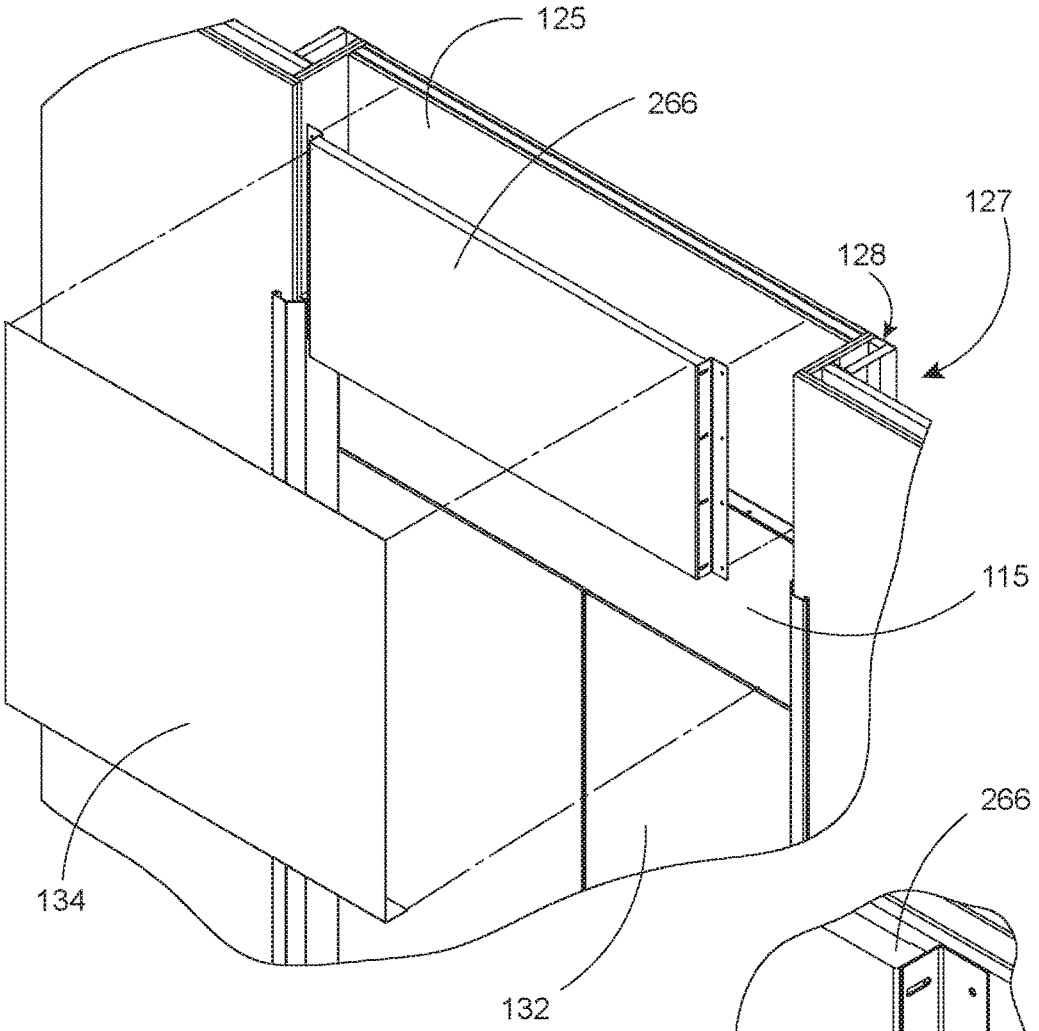
FIG. 24 is an exploded view of the fire-rated elevator door construction with a flush transom of FIG. 23.
Figure 25:
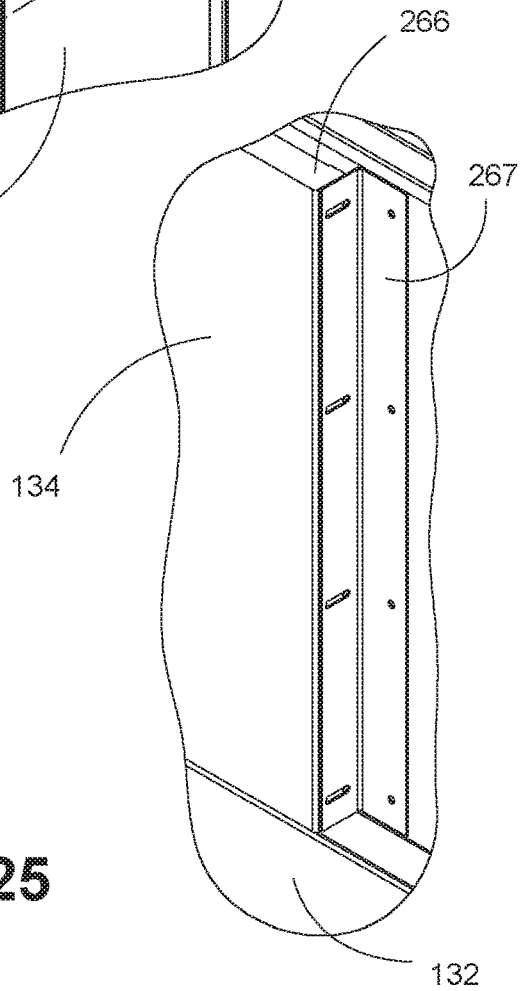
FIG. 25 is an enlarged view of the fire-rated elevator door construction with a flush transom of FIG. 23.

Architectural cladding 134 is flush with the face of doors 132. Behind the architectural cladding 134 is a fire-rated barrier 266, which can be a steel plate or other comparable non-combustible steel assembly having a depth of at least 1.25 inches. FIG. 24 is an exploded view of the construction of FIG. 23. FIG. 25 is a close-up view showing a bracket 267 that secures the fire-rated barrier 266 to the front face of the rear partition 125.

Figure 26:
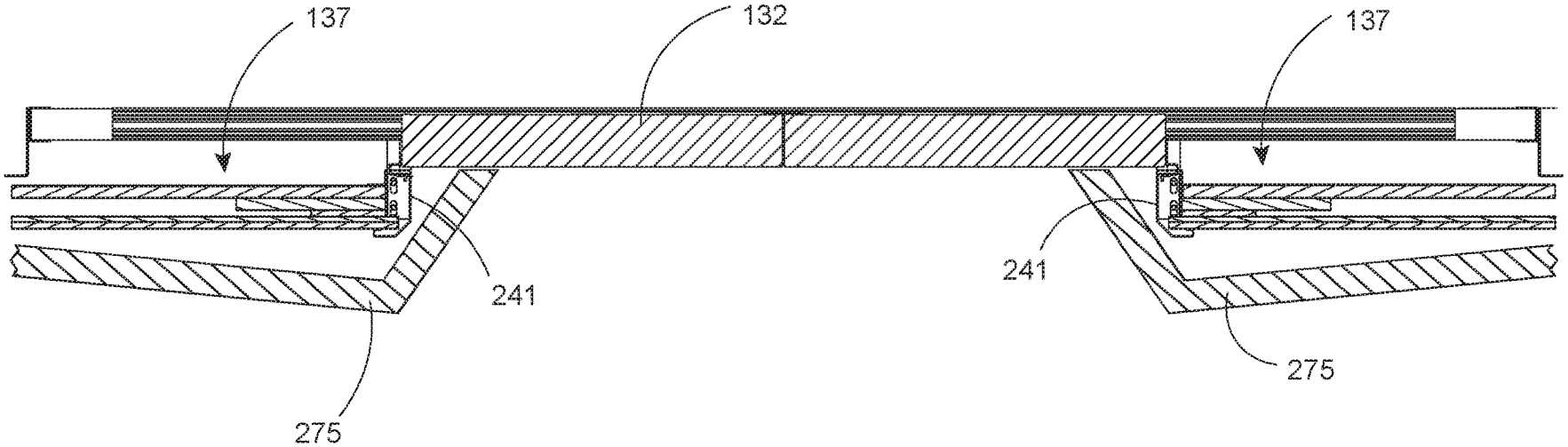
FIG. 26 is a cross-sectional view of an elevator frame and door assembly with architectural cladding according to some examples.

FIG. 26 shows an architectural wall configuration that can be used in connection with the fire-rated elevator door frame assemblies provided above. FIG. 26 is a cross-sectional view of the elevator frame and doors below the bottom of the transom. An architectural wall cladding 275 sits in front of a fire-rated shaft wall construction 137 on the corridor side of the elevator doors. The architectural wall 275 can be similar to the wall 175 shown in FIG. 1. The architectural wall 275 covers side jambs 241. The side jambs 241 have a beveled corner, which accommodates the angle of the architectural wall 275. The elevator doors 132 meet the architectural wall 275 such that the side jambs 241 and shaft wall construction 137 are not visible from the corridor.

Method of Assembling a Fire-Rated Elevator Door Frame Construction

One aspect of the technology provides a method of assembling an offset fire-rated elevator transom, the method comprising: assembling a transom assembly 101 by securing a support rail 112 to a top surface 104 of a transom 115, the transom 115 having a heat-shielding panel 109; releasably securing a retainer bar 119 to the support rail 112; constructing an elevator door assembly by assembling side jambs 141 to opposite sides of the transom assembly 101; removing the retainer bar 119 from the support rail 112; inserting a rear partition 125 onto the support rail 112; after inserting the rear partition 125, putting the retainer bar 119 back into place on the support rail 112 and securing the retainer bar 119 to the support rail 112, whereby the rear partition 125 is secured in place in the enclosure pocket 124 by the vertical stabilizer segment 116 of the support rail 112 and the vertical stabilizer segment 122 of the retainer bar 119; and securing the rear partition 125 to a perpendicular shaft wall assembly 127 with a barrier plate 128 on the rear surface 129 of the rear partition 125.

One aspect of the technology provides a method of assembling a fire-rated elevator door assembly, the method comprising: assembling the side jambs 141 to the transom assembly 101; installing the side jamb and transom assembly into a rough opening in the hoistway; assembling a front wall construction 137 comprising a corridor partition 135 and a shaft liner 136; installing a perpendicular shaft wall assembly 127 that is deeper than the transom assembly 101, the perpendicular shaft wall assembly 127 overlapping a part of the top 145 of the side jamb 141; inserting a rear partition 125 offset back from the transom 115 such that the bottom of the rear partition 125 is seated behind the transom 115 and lower than the top 104 of the transom 115; securing the rear partition 125 to the transom assembly 101 with a retainer bar 119; and securing the rear face 129 of the rear partition 125 to the hoistway-facing end 154 of the perpendicular shaft wall assembly 127 with a barrier plate 128; installing the hoistway door panels, wherein the transom front face 103 above the doors 132 is substantially flush with the elevator door face 133, whereby a continuous fire-rated barrier 144 is formed around the elevator door frame.

As used in this specification and the appended claims, the singular forms include the plural unless the context clearly dictates otherwise. The term "or" is generally employed in the sense of "and/or" unless the content clearly dictates otherwise. The phrase "configured" describes a system, apparatus, or other structure that is constructed or configured to perform a particular task or adopt a particular configuration. The term "configured" can be used interchangeably with other similar terms such as arranged, constructed, manufactured, and the like.

All publications and patent applications referenced in this specification are herein incorporated by reference for all purposes.

While examples of the technology described herein are susceptible to various modifications and alternative forms, specifics thereof have been shown by way of example and drawings. It should be understood, however, that the scope herein is not limited to the particular examples described. On the contrary, the intention is to cover modifications, equivalents, and alternatives falling within the spirit and scope herein.

The invention claimed is:

1. A transom assembly configured to be positioned between an elevator hoistway and an elevator corridor, comprising:

a transom having a hoistway side and a corridor side, the transom comprising:

a front panel with a front face, a top surface, and interior lock ribs;

a rear panel with a rear face and Z-ribs, wherein the lock ribs of the front panel and the Z-ribs of the rear panel secure the front panel to the rear panel;

a heat-shielding panel attached to the rear face of the transom rear panel by a horizontal z-bar retainer and at least one vertical z-bar retainer;

a support rail having a top flange with a top surface, a vertical stabilizer segment, a horizontal support segment, and a bottom flange, wherein the top flange of the support rail is secured to the top surface of the front panel of the transom and the support rail extends away from the hoistway side of the transom in a direction toward the elevator hoistway;

a retainer bar secured to the support rail, the retainer bar having a top flange, a bottom flange, and a vertical stabilizer segment extending between the top flange and the bottom flange;

an elongated horizontal enclosure pocket configured to receive a rear partition, the enclosure pocket formed on the hoistway side of the transom between the vertical stabilizer segment of the support rail and the vertical stabilizer segment of the retainer bar.

2. An assembly for an offset fire-rated elevator transom, comprising:

the transom assembly of claim 1;

a rear partition offset from the top surface of the transom and secured to the transom assembly in an enclosure pocket bounded by the vertical stabilizer segment of the support rail and the vertical stabilizer segment of the retainer bar.

3. An assembly for a flush elevator door and transom, comprising:

the transom assembly of claim 1;

a rear partition offset from the top surface of the transom;

at least one elevator door with elevator door cladding; and architectural cladding installed above the transom assembly, the architectural cladding being flush with the elevator door cladding.

4. A fire-rated elevator door frame assembly comprising:

the transom assembly of claim 1;

a rear partition offset from the top surface of the transom;

a front wall construction comprising a corridor partition and a shaft liner;

a perpendicular shaft wall assembly comprising a side partition and a perpendicular shaft liner;

wherein the rear partition is parallel to the corridor partition;

wherein the perpendicular shaft wall assembly situated between the rear partition and the corridor partition and the perpendicular shaft wall assembly separates the rear partition from the corridor partition;

wherein the perpendicular shaft wall assembly is perpendicular to the rear partition and the corridor partition; and wherein the elevator door frame is at least partially surrounded by a continuous fire-rated barrier.

5. The fire-rated elevator door frame assembly of claim 4, wherein the front wall construction is made of a material selected from a group consisting of gypsum, drywall, concrete, and masonry.

6. A fire-rated elevator door assembly comprising:

the transom assembly of claim 1;

elevator doors, wherein the transom assembly is seated above the elevator doors, side jambs on each side of the elevator doors;

a rear partition offset from the front face of the transom assembly and offset from a front face of the elevator doors;

a front wall construction comprising a corridor partition and a shaft liner;

a fire-rated perpendicular shaft wall assembly comprising a side partition, a perpendicular shaft liner, and a fire-rated filler sandwiched between the side partition and the perpendicular shaft liner;

wherein the front wall construction and the perpendicular shaft wall assembly meet in a perpendicular configuration over the top of the side jamb;

wherein the side jamb is flush with the top of the transom assembly;

wherein the side partition has a cutout in which a horizontal part of the cutout sits on top of the side jamb, and a vertical part of the cutout abuts the rear vertical face of the side jamb;

wherein the bottom of the perpendicular shaft wall assembly is substantially flush with the bottom of the rear partition;

a barrier plate that substantially overlaps the perpendicular shaft wall assembly and the rear face of the rear partition, wherein the barrier plate secures the rear partition to the perpendicular shaft wall assembly;

an elongate horizontal heat shield situated above the elevator door and below the bottom of the rear partition such that the heat shield juts out farther into a hoistway than the rear partition and the transom assembly;

architectural cladding above the top of the transom assembly; and elevator door cladding applied to the elevator door;

wherein the architectural cladding is flush with the elevator door cladding.

7. The fire-rated elevator door assembly of claim 6, wherein the front wall construction is made of a material selected from a group consisting of gypsum, drywall, concrete, and masonry.

8. A fire-rated shaft wall assembly having a hoistway side and a corridor side, the fire-rated shaft wall assembly comprising:

a fire-rated rear partition;

a fire-rated front wall construction comprising a corridor partition and a shaft liner;

a perpendicular fire-rated shaft wall assembly comprising a side partition, a perpendicular shaft liner, and a fire-rated filler sandwiched between the side partition and the perpendicular shaft liner, wherein the perpendicular shaft wall assembly comprises a hoistway-facing end and an opposite, corridor-facing end;

wherein, in combination with the rear partition, the perpendicular shaft wall assembly forms a portion of a continuous fire-rated barrier;

wherein the corridor-facing end of the perpendicular shaft wall assembly is interlocked with the front wall construction via the side partition perpendicularly intersecting and contacting the corridor partition, the shaft liner, and the rear partition;

wherein the hoistway-facing end of the perpendicular shaft wall assembly is secured to the rear partition;

wherein the perpendicular shaft liner intersects the shaft liner and is also offset from and perpendicular to the rear partition; and wherein an elevator door frame is at least partially surrounded by the continuous fire-rated barrier.

9. The fire-rated shaft wall assembly of claim 8, wherein the front wall construction is made of a material selected from a group consisting of gypsum, drywall, concrete, and masonry.

10. A method of assembling an offset fire-rated elevator transom configured to be positioned between an elevator hoistway and an elevator corridor, wherein the offset fire-rated transom has a hoistway side and a corridor side, comprising:

assembling a transom assembly by:

securing a support rail to a top surface of a transom, the transom having a heat-shielding panel, wherein the support rail extends away from the hoistway side of the transom in the direction of the elevator hoistway; and releasably securing a retainer bar to the support rail;

wherein the support rail has a vertical stabilizer segment and the retainer bar has a vertical stabilizer segment;

constructing an elevator door assembly by inserting the transom assembly into an elevator door frame;

removing the retainer bar from the support rail;

inserting a rear partition onto the support rail, wherein the rear partition is positioned on the hoistway side of the transom; after inserting the rear partition, putting the retainer bar back into place on the support rail, whereby the rear partition is secured in place in an enclosure pocket formed between the vertical stabilizer segment of the support rail and the vertical stabilizer segment of the retainer bar; and securing the rear partition to a perpendicular shaft wall assembly with a barrier plate on each side end of a rear face of the rear partition.

11. A method of assembling a fire-rated elevator door assembly, comprising:

assembling the transom according to the steps of claim 10;

assembling side jambs to the transom to form a side jamb and transom assembly;

installing the side jamb and transom assembly into a rough opening in a hoistway;

assembling a front wall construction comprising a corridor partition and a shaft liner;

installing the perpendicular shaft wall assembly that is deeper than the transom assembly, the perpendicular shaft wall assembly overlapping a part of a top of the side jamb;

wherein the step of inserting the rear partition comprising inserting the rear partition offset back from the transom such that a bottom of the rear partition is seated behind the transom and lower than the top of the transom;

securing the rear partition to the transom assembly with the retainer bar; and wherein the step of securing the rear partition to the perpendicular shaft wall assembly further comprises securing the side end of the rear face of the rear partition to a hoistway-facing end of the perpendicular shaft wall assembly with the barrier plate; and installing hoistway door panels wherein a transom front face above the doors is substantially flush with an elevator door front face;

whereby a continuous fire-rated barrier is formed around the elevator door frame.

12. The method of claim 11, wherein the front wall construction is made of a material selected from a group consisting of gypsum, drywall, concrete, and masonry.

* * * * *